United States Patent [19]

Villella

[11] 4,291,651

[45] Sep. 29, 1981

[54] INTERNAL COMBUSTION ENGINE

[76] Inventor: Tony R. Villella, 2030 N. Black Canyon Hwy., Phoenix, Ariz. 85009

[21] Appl. No.: 949,372

[22] Filed: Oct. 6, 1978

[51] Int. Cl.[3] ..... F02B 57/06

[52] U.S. Cl. ..... 123/44 R; 123/41.32; 123/44 A; 123/44 D; 123/44 C

[58] Field of Search ..... 123/44 R, 44 A, 44 C, 123/44 D, 44 E, 43 R, 169 CB, 169 C, 169 PA, 169 PH, 41.32

[56] References Cited

U.S. PATENT DOCUMENTS

| | | | |
|---|---|---|---|
| 927,255 | 7/1909 | Low | 123/169 PA |
| 1,956,805 | 5/1934 | Meyer | 123/169 PH |
| 1,993,014 | 5/1935 | Mascuch | 123/169 PH |
| 2,534,860 | 12/1950 | Fisher | 123/41.32 |
| 2,646,782 | 7/1953 | Fisher | 123/169 C |
| 3,181,523 | 4/1965 | Casey | 123/169 PH |
| 3,599,612 | 8/1971 | Villella | 123/44 D |
| 3,739,756 | 6/1973 | Villella | 123/44 D |
| 3,881,454 | 5/1975 | Jaulmes | 123/65 P |

FOREIGN PATENT DOCUMENTS

| | | | |
|---|---|---|---|
| 83466 | 4/1921 | Austria | 123/44 C |

*Primary Examiner*—Wendell E. Burns
*Attorney, Agent, or Firm*—Don J. Flickinger

[57] ABSTRACT

A pump supplies pressurized lubricant to an internal combustion engine from an external reservoir through a closed loop system. Delivery channels extending through the crankshaft, connecting rod and other components, supply the pressurized lubricant to the several areas of relative movement. Return channels, extending through the components, conduct lubricant from the several areas to the reservoir. Fuel-air mixture from a carburetor enters the crankcase through the open end of the crankshaft and moves through ports within the several cylinders to the respective combustion chambers. Selected ports are sequentially closed by a valve plate carried by the crankshaft. Incomplete products of combustion are exhausted into an auxiliary exhaust outlet for recycling with the fuel-air mixture. Retainer members engaging the spark plugs assist in dissipating heat therefrom.

21 Claims, 36 Drawing Figures

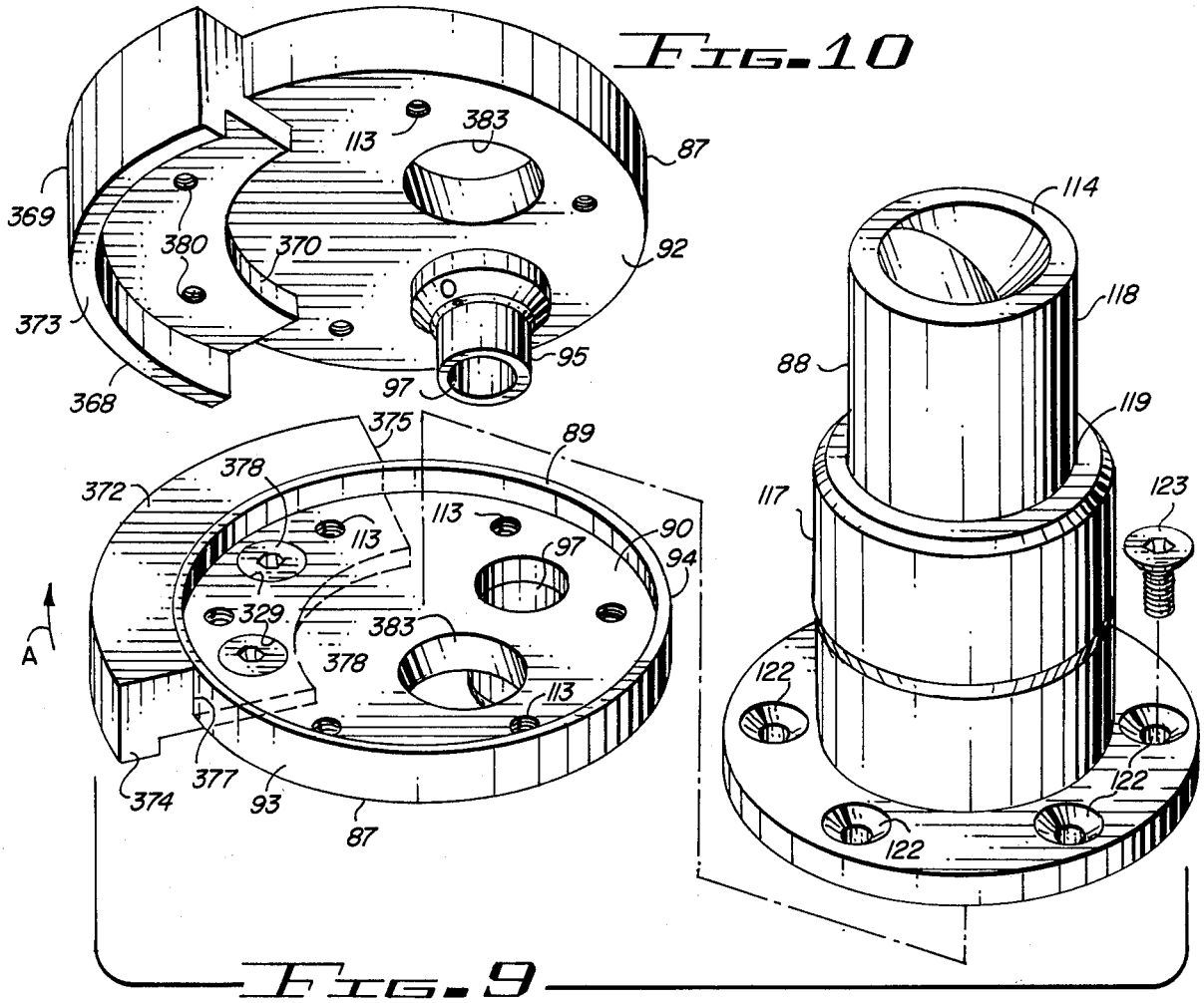
FIG. 10
FIG. 9
369
373
368
380
370
113
383
87
92
95
97
375
89
372
378
113
90
94
329
383
378
113
A
374
377
93
87
114
118
88
119
117
123
122
122
122
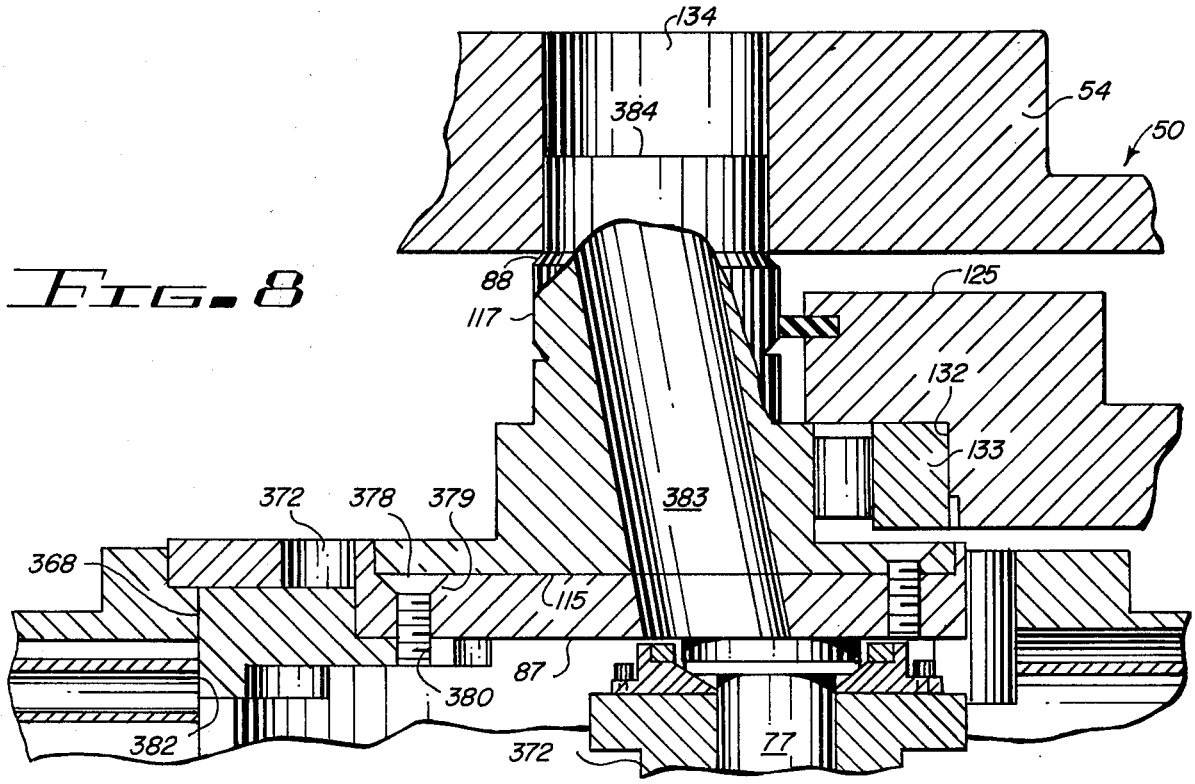
FIG. 8
134
384
54
50
88
117
125
132
133
372
378
379
383
368
115
87
380
382
372
77

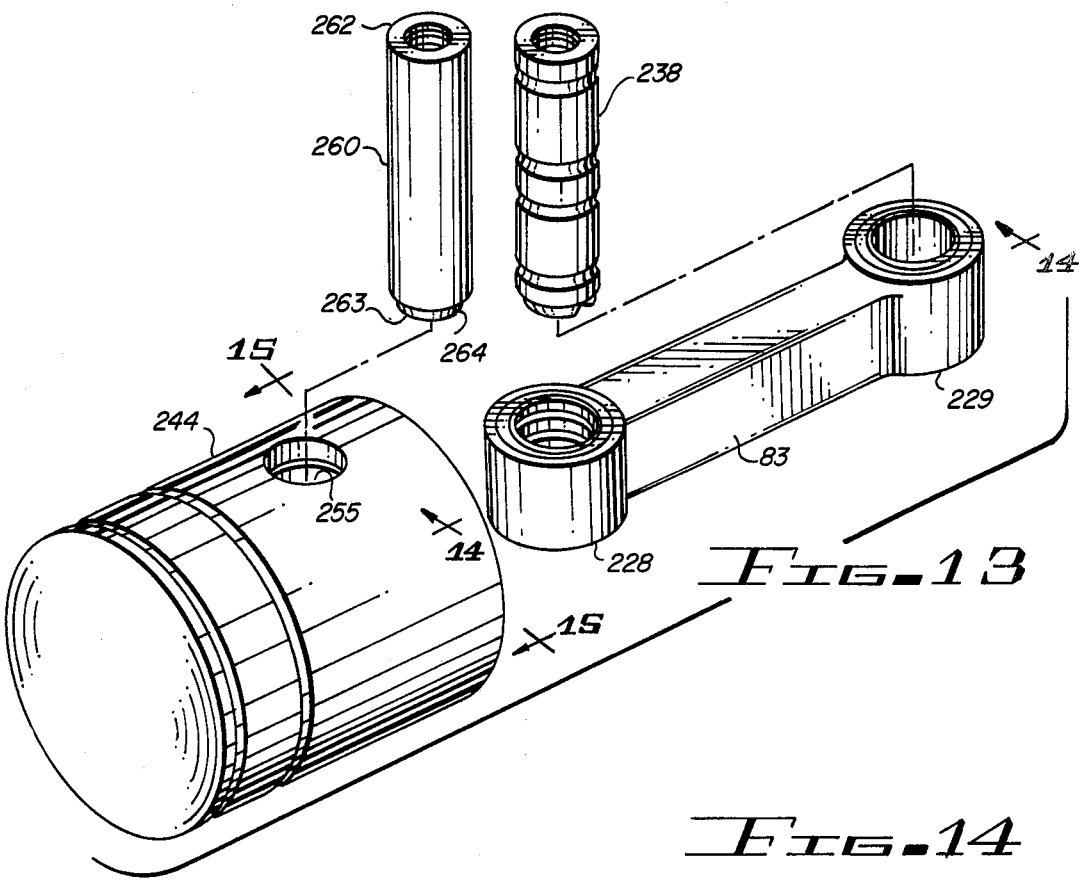
FIG. 13
FIG. 14
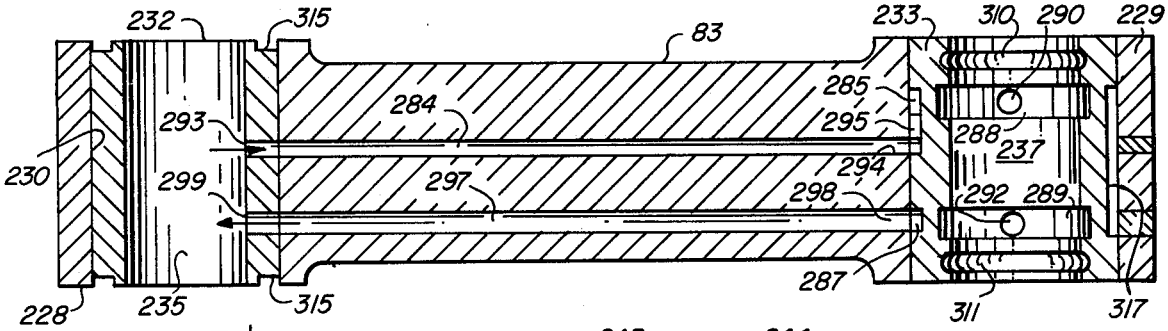
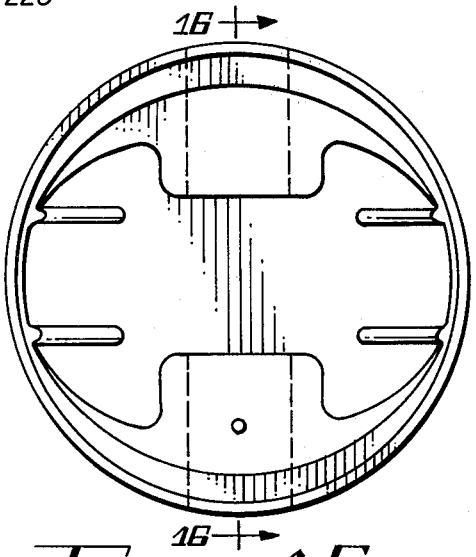
FIG. 15
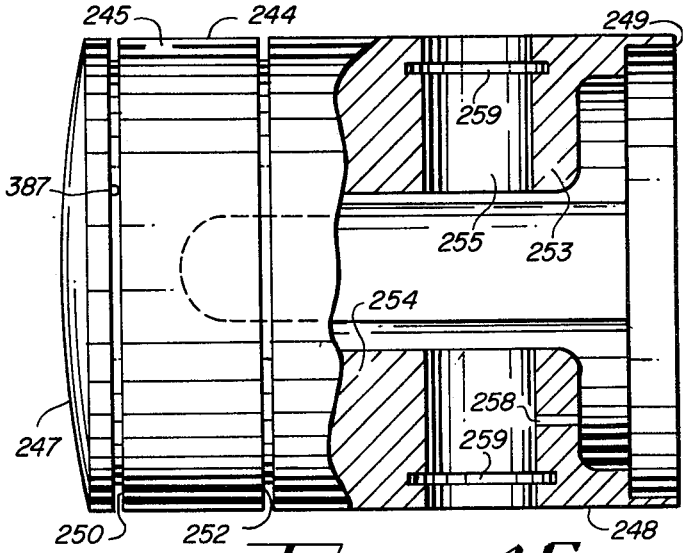
FIG. 16

INTERNAL COMBUSTION ENGINE

This invention relates to internal combustion engines.

In a further aspect, the present invention relates to improvements for internal combustion engines.

More particularly, the instant invention concerns improvements in the lubrication system, intake and exhaust systems and other areas common to internal combustion engines.

Internal combustion engines of the general type, having a piston reciprocally moveable within a cylinder, are well known. Briefly, such engines, commonly include a crankshaft, rotatably journalled within a crankcase. A connecting rod interconnects the piston and the crankshaft. Conventionally, one end of the connecting rod is journalled about the crankshaft while the other end thereof, is pivotally connected to the piston by means of a wrist pin.

The prior art is replete with various specific engine configurations based upon the foregoing general concept. Commonplace, are engines having either a single cylinder or a plurality of cylinders. Multiple cylinder designs include the familiar in-line, V-type and radial configurations. Generally, in-line and V-type engines, have a stationary crankcase and a rotating crankshaft. Radial engines, on the other hand, commonly include a stationary crankcase with a rotating crankshaft, or alternately, a stationary crankshaft with a rotating crankcase.

Engines of the immediate type share common characteristics. Inherent, is a fuel-air intake system, including facilities for mixing fuel and air in a proper ratio and moving the mixture into the one or several combustion chambers. The products of combustion are discharged through an exhaust system. Combustion of the fuel-air mixture within the combustion chamber, is effected by an igniter device referred to as a spark plug. It is also required that the several areas of relative movement, such as the bearing surfaces between the journalled and pivotally connected parts, be provided with a lubricant.

Two basic types of lubrication systems are well known. In accordance with one of the systems, lubricating fluid, generally oil, is held in a reservoir, either forming a part of or adjacent and open to the interior of the crankcase. A pump delivers oil from the reservoir through primary supply channels within the crankcase to the areas of relative movement between the crankshaft and the crankcase, commonly referred to as the main bearings. The oil passes through openings in the main bearings to the surface between the main bearings and the crankshaft. Secondary supply channels communicate through the crankshaft between the main bearings and the area of relative movement, between the crankshaft and the connecting rod, colloquially termed the rod bearings. After passing between the bearing surfaces, the oil drains through the crankcase during the return to the reservoir. Other areas of relative movement within the engine, such as between the connecting rod and the piston and between the piston and the cylinder walls, are generally lubricated on a splash system.

Frequently, air-cooled engines and two-cycle engines are lubricated by oil entrained in the fuel-air mixture. Oil is mixed with the fuel in ratios generally ranging from one part oil to sixteen parts fuel, to one part oil to thirty-two parts fuel. The intake system communicating between the carburetor and the combustion chamber is routed through the crankcase of the engine, during which time oil is deposited upon the various areas of relative movement.

Various limitations are inherent in either lubrication scheme. For obvious reasons, a reservoir type oil system is not compatible with engines having intake systems routed through the crankcase. The oil would be absorbed into the fuel-air mixture, eventually depleting the oil supply and diluting and contaminating the fuel. Oil within the fuel-air mixture is burned within the combustion chamber, leaving undesirable residue and fouling working components, such as spark plugs, and tending to seize the piston rings within the ring grooves. Further, the presence of substantial amounts of oil reduces the effectiveness of the fuel-air mixture, causing pre-ignition, loss of power and other problems.

For the foregoing and other reasons, engines of the type which are lubricated by oil entrained in the fuel-air mixture, have achieved only limited success being used primarily in small engines. Larger engines, especially those primarily used for heavy duty industrial applications and for passenger and cargo carrying vehicles, generally are provided with a reservoir type lubrication system. In the latter type of engine, oil also frequently enters the combustion chamber with attendant problems. The oil is drawn into the combustion chamber as a result of decreased pressure within the combustion chamber during the intake stroke, and increased pressure within the crankcase, due to elevated temperatures. Residue, the products of incomplete combustion, pass from the combustion chamber into the crankcase, contaminating the oil, resulting in reduced lubrication effectiveness and requiring frequent oil changes. Other undesirable characteristics of either type of lubrication system will readily occur to those skilled in the art.

Intake and exhaust systems associated with conventional engines, especially those having sleeve type valves, have proven to be less than satisfactory and have contributed to the lack of popularity of such engines. The intake valves are open during a portion of the compression stroke. Accordingly, a quantity of the fuel-air mixture drawn into the cylinder, during the intake stroke, is discharged through the intake valves during the compression stroke. Resultingly, fuel intake pressures have been increased, especially by the use of auxiliary blowers, which encumber the engine and require input power. In order to distribute the fuel-air mixture to the several cylinders of a multicylinder engine, the prior art has resorted to inordinately complex mechanisms and schemes.

Due to current environmental awareness, considerable attention has been directed to exhaust systems. Incomplete products of combustion are responsible for substantial atmospheric pollution. In order to curtail the discharge of pollutants, the prior art has resorted to exceedingly complex and wasteful schemes.

A currently popular scheme involves the use of an auxiliary device installed into the exhaust system for the purpose of neutralizing pollutants. The device operates in connection with an altered ignition advance curve, generally retarding the ignition timing, and other engine appendages. In addition to increased manufacturing and maintenance costs, the scheme has had the general effect of reducing the power output of the engine and requiring a special extra cost fuel recently developed for the purpose.

Another area of general concern centers upon the spark plug. Spark plugs are subjected to substantial heat and vibration. Heat generally reduces the effectiveness of the spark plug while vibration can either break or loosen the spark plug resulting in the loss of power output from the respective cylinder. Heat dissipation problems are particularly acute in air-cooled engines. Vibration problems are particularly noted in engines having aluminum cylinders which limit the torque with which the spark plug may be tightened.

The foregoing discussion is based upon common knowledge of conventional internal combustion engines. Other undesirable characteristics associated therewith will readily occur to those skilled in the art.

It would be highly advantageous, therefore, to provide an internal combustion engine having improvements to remedy the foregoing and other deficiencies associated with the prior art.

Accordingly, it is an object of the present invention to provide an improved internal combustion engine.

Another object of the invention is the provision of an internal combustion engine having improved lubrication means.

And another object of the invention is to provide an improved lubrication system for delivering pressurized lubricant to the several areas of relative movement within an internal combustion engine.

Still another object of this invention is the provision of an internal combustion engine which is relatively free of lubricant in areas not requiring lubrication.

Yet another object of the invention is to provide an internal combustion engine in which the lubricant is not readily subject to the contaminants normally associated with internal combustion engines.

Still another object of the invention is the provision of an internal combustion engine having improved means for dissipating heat from a spark plug.

And yet another object of the invention is to provide an internal combustion engine having improved spark plug retention means.

A further object of the instant invention is the provision of an internal combustion engine of the port-valve type having an improved fuel-air intake system.

And a further object of the invention is to provide a port-valve type internal combustion engine having improved intake and exhaust valving.

Yet a a further object of the invention is the provision of an internal combustion engine of the port-valve type in which the intake charge is restrained against the compression stroke of the piston.

Still another object of the invention is to provide an internal combustion engine in which unburned products of combustion are recycled for further burning.

And still a further object of the immediate invention is the provision of a normally aspirated internal combustion engine which can operate either as a two-cycle or four-cycle engine.

Yet still a further object of the invention is to provide an internal combustion engine having improved means for lubricating the exhaust valve seals.

The improved internal combustion engine of immediate concern was reduced to practice in a radial engine configuration based upon the general type set forth in U.S. Pat. Nos. 3,599,612 and 3,739,756, issued Aug. 17, 1971 and June 19, 1973, respectively, in the name of the instant applicant. The disclosures of said patents, which represent the closest prior art of which applicant is aware, are hereby incorporated by reference into the present application.

The referenced patents disclose various features of internal combustion engines, the preferred embodiment of which is illustrated and described in connection with a seven-cylinder configuration. For purposes of illustration, the ensuing description is made with reference to an engine of five cylinders. It is understood that various features, structure and function, set forth in the referenced patents are applicable to the engine of the instant invention. Further, it is understood that the immediate disclosure has utility for engines of various numbers of cylinders and for engines of diverse configurations.

Several areas of relative movement, each requiring continuous lubrication, are common to internal combustion engines of the type having a piston slideably disposed within a cylinder. The first area of relative movement is between the crankshaft and the crankcase in which it is journalled, commonly referred to as a main bearing. A second area of relative movement exists between the crankshaft and the first end of a connecting rod journalled thereon, commonly referred to as a rod bearing. The pivotal connection between the second end of the connecting rod and a piston, generally including a wrist pin, defines a third area of relative movement.

Briefly to achieve the desired objects of the instant invention in accordance with a preferred embodiment thereof, first provided is a reservoir remote from the crankcase for holding a supply of lubricant, such as oil. A primary delivery channel extends longitudinally within the crankshaft. A pump draws lubricant from the reservoir and supplies a pressurized lubricant to the primary delivery channel. Lubricant from the primary delivery channel passes through the first area of relative movement and is returned to the reservoir through a primary return channel extending longitudinally within the crankshaft. Seals engaging the crankshaft and the crankcase retain the lubricant within the first area.

Seals are also positioned on either side of the second area of relative movement. A supply passage communicates between the primary supply channel and the second area for delivering pressurized lubricant to the second area. Lubricant from the second area is returned to the primary return channel through a return passage.

A secondary supply channel extending through connecting rod receives pressurized lubricant from the second area and delivers the pressurized lubricant to the third area of relative movement. Lubricant from the third area of relative movement is returned through a secondary return passage to the second area of relative movement. Seals are provided for retaining the lubricant within the third area of relative movement.

In response to rotation of the crankcase and the attendant centrifugal force, fuel-air mixture is drawn from a carburetor through an opening in the crankshaft into the interior of the crankcase. Subsequently, the mixture moves through a port communicating between the interior of the crankcase and the combustion chamber. In a timed sequence, a valve plate carried by the crankshaft closes the port to prevent expulsion of the mixture from the combustion chamber as the piston begins the compression stroke.

Exhaust gases, in accordance with the instant invention, are discharged through selective port valves. A primary exhaust port, which communicates with an environmental discharge exhaust system, receives the initial gases of combustion. An intermediate exhaust port receives the initial gases of combustion for recirculation to the carburetor and subsequent re-burning. A portion of the final exhaust gases are held in suspension and discharged through a final exhaust passage. During the suspension period trace amounts of oil, initially contained within the fuel-air mixture, settle out to lubricate the exhaust seals.

The improved internal combustion engine further includes a retainer member which engages over the spark plug and is retained within the cylinder, preferably by a snap ring. The retainer assists in dissipating heat from the spark plug. Further, the retainer holds the spark plug against vibration.

The foregoing and further and more specific objects and advantages of the present invention will become readily apparent to those skilled in the art from the following detailed description thereof taken in conjunction with the drawings in which:

FIG. 8 is an enlarged view of the upper end of the illustration of FIG. 3 especially showing the removable end of the crankshaft;

FIG. 9 is an exploded top perspective view of the components of FIG. 8 as they would appear when removed from the crankshaft;

FIG. 10 is a bottom perspective view of the end plate as seen in FIG. 9;

FIG. 13 is an exploded perspective view of an assembly including a leaf connecting rod and a piston useful in connection with the instant invention;

FIG. 14 is a vertical sectional view of the leaf rod of FIG. 13 and taken along the line 14–14 thereof;

FIG. 15 is a vertical sectional view of the piston of FIG. 13 and taken along the line 15–15 thereof;

FIG. 16 is a side elevation view of the piston of FIG. 13, partly in vertical section, taken along the line 16–16 of FIG. 15;

GENERAL STRUCTURE OF THE ENGINE

Figure 1:
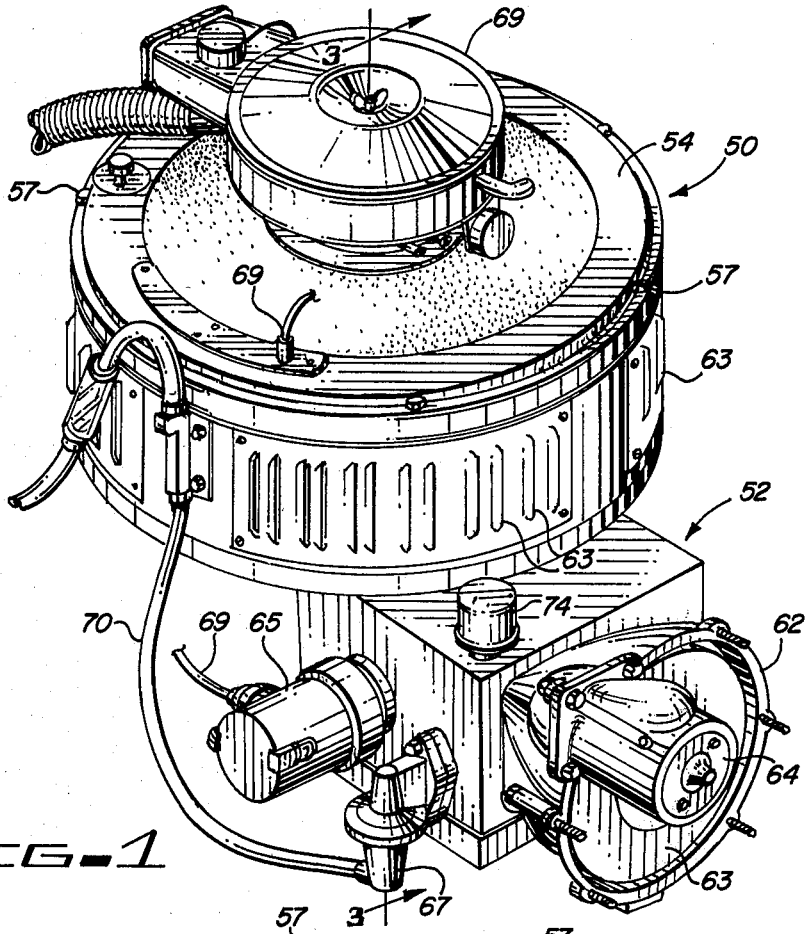
FIG. 1 is a top perspective view of an improved internal combustion engine constructed in accordance with the teachings of the instant invention.
Figure 2:
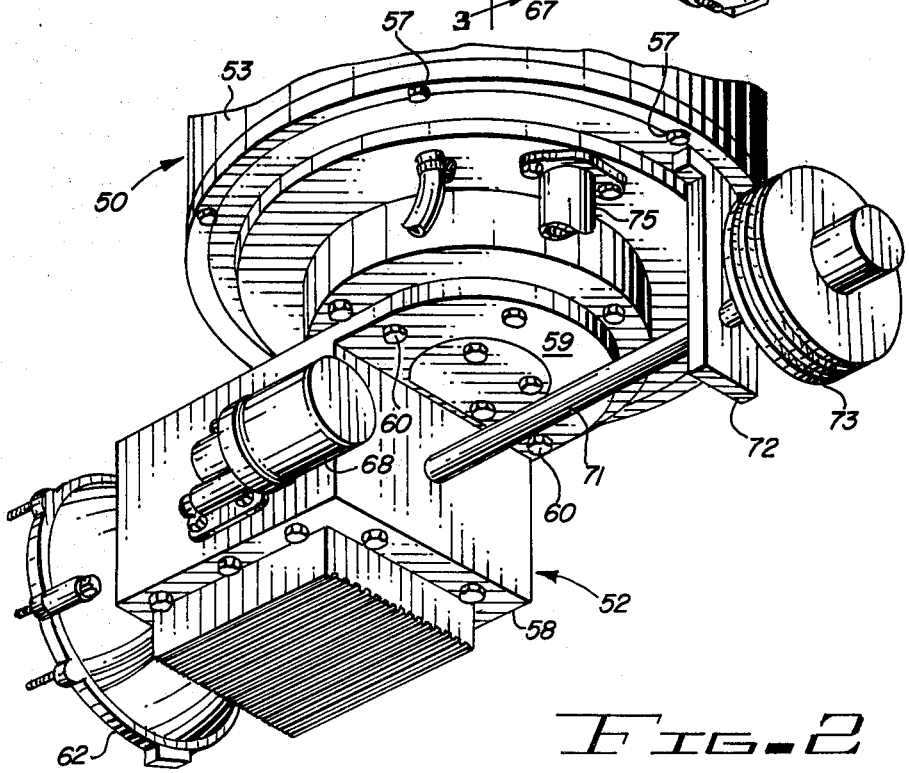
FIG. 2 is a bottom perspective view of the engine of FIG. 1, the upper portion thereof being broken away.

Turning now to the drawings, wherein like reference characters indicate corresponding elements throughout the several views, attention is first directed to FIG. 1 and 2, which show the outer housing generally designated by the reference character 50 and the gear case generally designated by the reference character 53. Outer housing 50, which contains the power plant, includes cylindrical cage 53, having upper and lower main plates 54 and 55, respectively, secured thereto by means of bolts 57. Gear case 52, which contains an angular drive unit, includes housing 58, having mounting flange 59 which is secured to lower main plate 55 by means of bolts 60. The assembly is considered stationary and is normally held against rotation by means of mounting, such as in the engine compartment of a vehicle, as illustrated in the referenced patents.

As further seen in the external views of FIGS. 1 and 2, bell housing 62 enclosing fly wheel 63 is secured to housing 58. In accordance with conventional practice, bell housing 62 provides a mounting bracket for attaching a transmission to the engine of the instant invention. The transmission may be either of the manual or the automatic type. As will be readily understood by those skilled in the art, fly wheel 63 is especially useful in connection with a manual transmission and may be replaced by a torque converter to accommodate an automatic transmission. Starter 64 engages a ring gear carried either by the fly wheel or the ring gear during cranking and starting of the engine.

Distributor 65, fuel pump 67 and oil filter 68 are also carried by housing 58. Distributor 65, by means of electrical conductor 69, provides a timed electrical impulse to upper main plate 54. A carburetor and air cleaner assembly 691 is provided fuel through line 70 extending from fuel pump 67. Oil filter 68 operates in connection with an oil pump and oil supply contained within gear case 52.

Fly wheel 63 is secured to one end of an output drive shaft rotated by the engine. An auxiliary drive shaft 71, an extension of the main drive shaft, extends through housing 58 and is supported by pillow block 72. A multi-groove pulley 73 is rotatably carried by auxiliary drive shaft 71 and provides a power take-off for vehicle accessory items, such as air conditioning compressor, power steering unit and power brake unit. Also seen in the immediate views are gear case ventilator 74 and exhaust pipe 751. Exhaust conduit 76 is part of the exhaust gas return system and communicates with the carburetor and air cleaner assembly 691.

Figure 3:
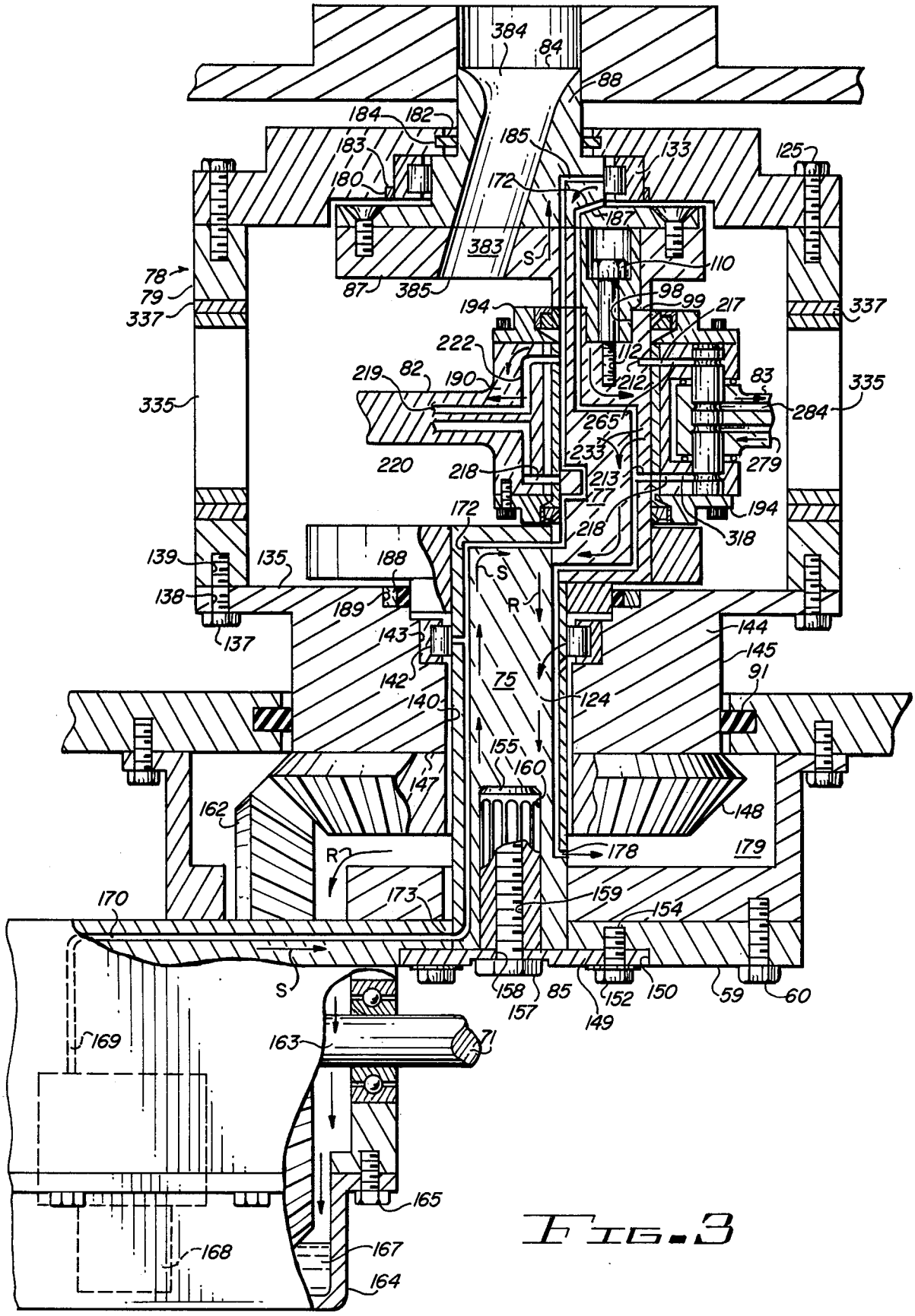
FIG. 3 is an enlarged vertical sectional view taken along the line 3—3 of FIG. 1, partially broken away, and specifically illustrating the crankshaft and the interior of the crankcase.

Briefly, an engine of the instant type, as further described in the referenced patents, includes a stationary crankshaft having a single offset journal 77, as seen in FIG. 3. Crankshaft 75 extends upwardly to upper main plate 54, extending through the cylinder block, generally designated by the reference character 78. The cylinder block, as further viewed in FIG. 6., includes a pentagonal crankcase 79 having five cylinder assemblies 80 extending radially therefrom.

Master rod 82 has one end thereof rotatably journalled on offset main journal 77. A piston rotatably secured to the other end of master rod 82 is slideably disposed within one of said cylinder assemblies 80. A plurality of leaf rods 83 are rotatably affixed to master rod 82 at one end thereof and at the other end thereof carry a pivotally connected piston slideably disposed within respective cylinders 80. Cylinder block 78 rotates in the direction of arrow A (FIG. 6) during operation.

Certain of the foregoing described components are described in further detail in the referenced patents. A more thorough understanding of other components will be had as the description ensues. Still, various components are well known to those skilled in the art and further comment will not be made herein.

POWER TRANSMISSION

In the preferred embodiment of the engine, crankshaft 75 is oriented vertically, having upper end 84 and lower end 85, as viewed in FIG. 3. Crankshaft 75 is segmented, having an end plate 87 and a shaft extension 88 secured to the upper end. End plate 87, as further seen in FIGS. 8, 9 and 10, includes disc-like member 89, having upper surface 90, lower surface 92, peripheral edge 93 and upstanding lip 94. Cylindrical projection 95 depends from lower surface 92, at a position spaced from the axial center of end plate 87 an amount equal to the offset of main journal 77. Counterbored hole 97 extends axially through cylindrical projection 95. Journal 77 has a bore 98 extending inwardly from the free end 99 thereof, which receives projection 95 in a locational fit. Bolt 110 extends through counterbored hold 97 and engages threaded aperture 112 within journal 77 for retaining end plate 87. Several spaced apertures 113 extend through disc-like member 89.

Shaft extension 88, having upper end 114 and lower end 115, includes cylindrical portion 117 and reduced diameter portion 118, having shoulder 119 formed therebetween. Radial flange 120 extends from cylindrical portion 117 at lower end 115. Holes 122 extend through flange 120 and are spaced to correspond with respective threaded apertures 113.

Upper surface 90 and peripheral edge 93 of end plate 87 form a next for locationally receiving flange 120 of shaft extension 88. Bolts 123 extend through holes 122 and are engaged within threaded apertures 113 for securement of shaft extension 88 to end plate 87. When end plate 87 and shaft extension 88 are assembled as part of the crankshaft 75, cylindrical portion 117 and reduced diameter cylindrical portion 118 are axially aligned with lower shaft section 124.

Crankcase 79, as especially seen in FIGS. 3 and 8, has a top cover 125 which is secured thereto by a plurality of bolts 127 which extend through openings 128 in cover 125 and engages threaded holes 128 in crankcase 79. Axial bore 130 extends through cover 125 and includes counterbore 132 in which resides bearing assembly 133. Bearing 133 also locates on cylindrical portion 117 of shaft extension 88. Thus, it is seen that the upper portion of cylinder block 78 is rotatably mounted on crankshaft 75. Reduced diameter cylindrical portion 118 of shaft extension 88 is locationally received within bore 134 formed axially in upper main plate 54 of outer housing 50. As previously noted, crankshaft 75 and outer housing 50 are stationary, and there is no relative movement of cylindrical portion 118 within bore 134.

Figure 5:
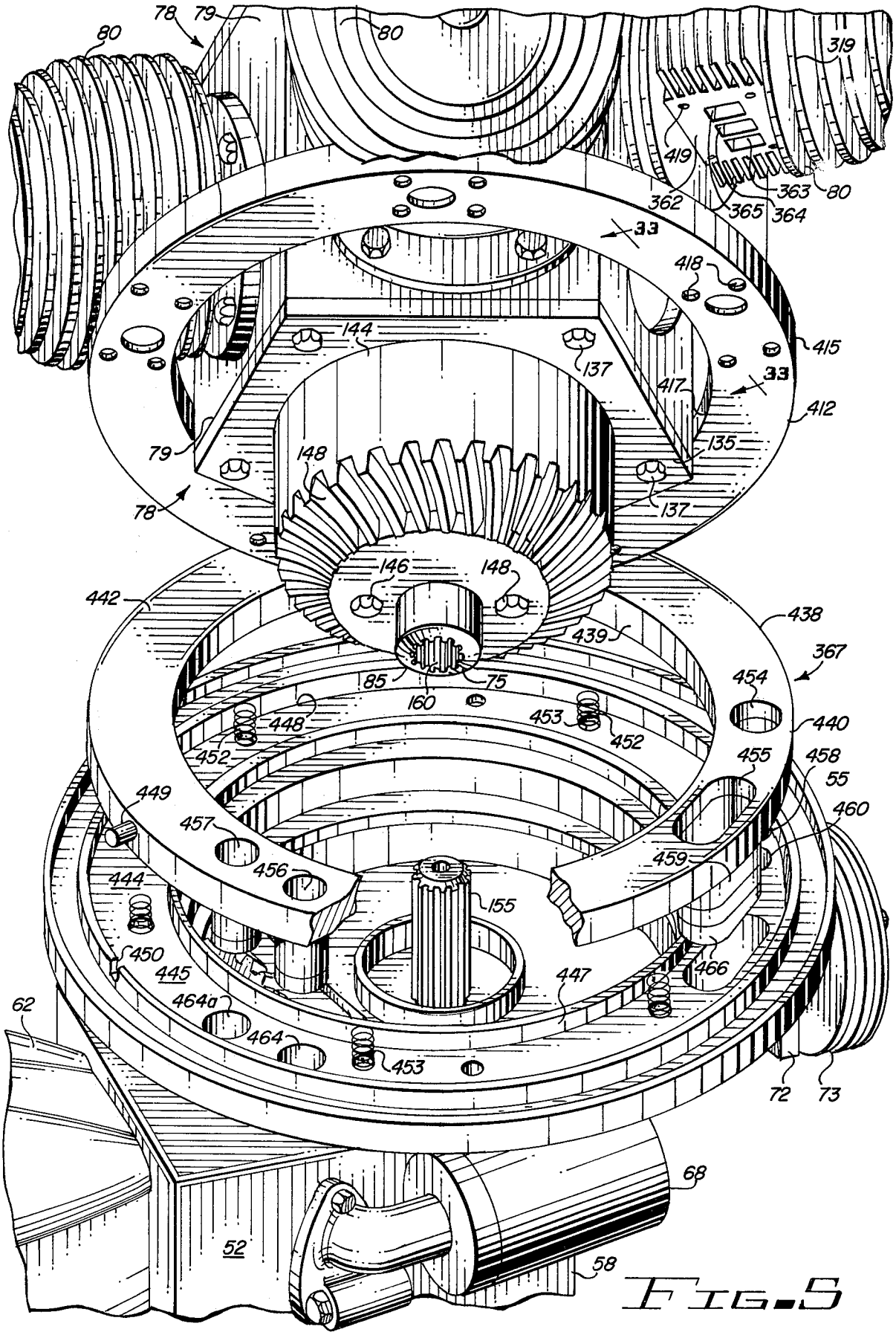
FIG. 5 is an exploded fragmentary view of the engine of FIG. 1, as it would appear with the outer housing removed and the gear case separated from the crankcase.

Cylinder block 78, as depicted in FIGS. 3 and 5, also has a bottom cover plate 135 which is secured to crankcase 79 by means of bolts 137 which pass through openings 138 and engage threaded holes 139. Axial bore 140, extending through bottom cover plate 135, rotatably receives lower shaft section 124 of crankshaft 75 therethrough. Bearing assembly 142 resides in counterbore 143 concentric with bore 140. Bearing 142 rotatably supports the lower end of cylinder block 78 relative crankshaft 75.

Hub 144, having outer cylindrical surface 145 and lower end surface 147 depends from bottom cover plate 135. Beveled gear 148 abuts lower end surface 147 and is axially secured to hub 144 by bolts 146. Bolts 146 extend through beveled gear 148 and threadedly engage hub 144 in accordance with conventional practice. A mounting plate 149 is located within recess 150 on the underside of mounting flange 59. Bolts 152 extend through arcuate slots 153 and are engaged with threaded apertures 154 in mounting plate 59 for purposes of securing mounting plate 149 to mounting flange 59. Arcuate slots 153 provide for limited rotation of plate 149 about the vertical longitudinal axis of the engine, as will be described hereinafter in further detail. Splined shaft 155 is secured to mounting plate 149 by bolt 157 which extends through opening 158 in plate 149 and engages threaded aperture 159 within shaft 155. Splined shaft 155 extends upwardly from mounting plate 149 and is axially received within splined bore 160, extending inwardly from the lower end 85 of crankshaft 75.

Splined shaft 155 secures crankshaft 75 against movement of gear case 52 and outer housing 50. Bearing assemblies 133 and 142 rotatably journal cylinder block 78 about crankshaft 75. During operation of the engine, cylinder block 78 rotates relative crankshaft 75. The power output for cylinder block 78 is hub 144 and beveled gear 148. Beveled gear 148 in turn drives complemental beveled gear 162, which is drivingly carried by power output drive shaft 163. The journalling of power output drive shaft 163 and other structure associated with gear case 52 can be had with reference to U.S. Patent No. 3,599,612. Fly wheel 63 is, of course, secured to one end of power output drive shaft 163, while auxiliary drive shaft 71 extends from the other end thereof.

THE LUBRICATION SYSTEM

A sump type oil pan 164 is secured to the underside of housing 58 in a conventional manner by a plurality of bolts 165. A reservoir of lubricant, such as oil 167, is held within oil pan 164. The lower portion of gear 162 resides within reservoir 167, and by the conventional splash system, lifts oil to lubricate the contacting surfaces between the beveled gears 162 and 148.

The oil 167 from pan 164 is also used to lubricate the moving components of the engine within a closed lubrication system. For this purpose, a conventional oil pump 168, as illustrated in FIG. 3, resides within oil pan 164. Oil filter 68, in accordance with conventional practice, is connected in series between oil pump 168 and the oiling system of the engine. Oil pump 168 has an outlet conduit which delivers pressurized oil to an oil passage 170 within housing 58. Oil passage 170 communicates with and provides pressurized oil to primary supply channel 172, extending within crankshaft 75. Primary supply channel 172 has an inlet which aligns with oil passage 170 and an end 174 which terminates proximate upper end 84 in the proximity of upper bearing assembly 133. Primary return channel 175 extends through crankshaft 75 approximately parallel to main supply channel 172. Primary return channel 175 has an upper end 177 proximate upper end 84 of crankshaft 75 in the region of upper main bearing assembly 133 and an outlet 178 which discharges oil into cavity 179 which also contains beveled gear 148. Oil within cavity 179 returns by gravity flow to sump 164 through openings 171 on either side of oil passage 170. In the ensuing description, arrowed lines referenced by the character 'S' indicate the direction of flow of pressurized oil supply. Arrowed lines denoted by the character 'R' indicate oil return.

Figure 4:
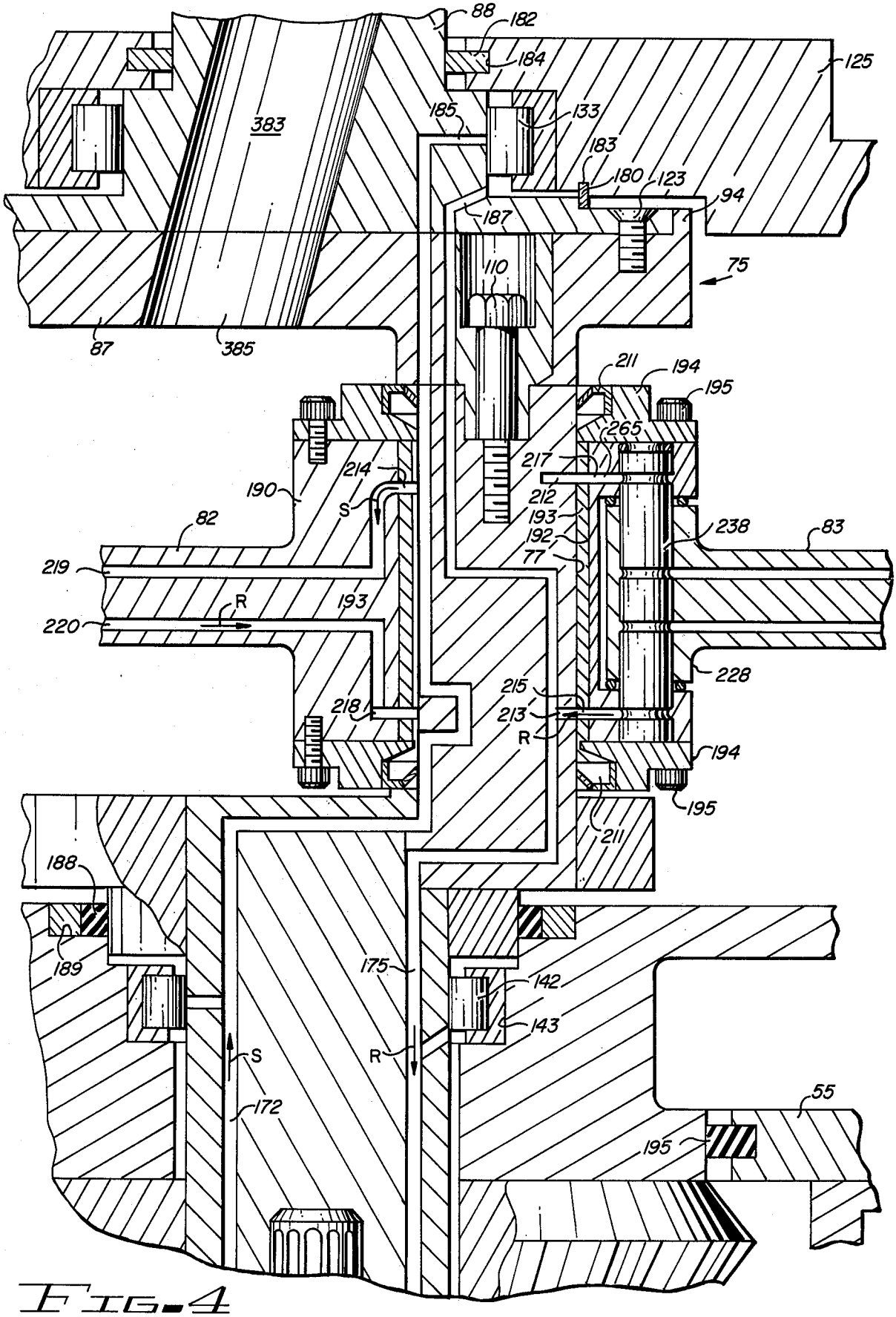
FIG. 4 is an enlarged fragmentary view of a portion of the illustration of FIG. 3, particularly showing the journalling of the crankshaft within the crankcase and the journalling of the connecting rod on the crankshaft.

Inner seal 180 and outer seal 182, as also seen in FIG. 4, are carried on respective sides of upper main bearing assembly 133. Inner main seal 180 is carried in groove 183 in top cover 125 and seals against crankshaft 75 to prevent oil from reaching the interior of crankcase 79. Similarly, outer seal 182 resides in groove 184 formed in top cover 125 and sealingly engages crankshaft 75 to prevent the passage of oil into the area between outer housing 50 and cylinder block 78. Oil is delivered to bearing assembly 133 through passage 185 extending from primary supply channel 172. After lubricating bearing 133, oil returns through passage 187 to primary return channel 175.

Lower main bearing assembly 142 is similarly provided with seals and supplied with oil. Inner seal 188 resides in groove 189 in bottom cover plate 135 and seals against crankshaft 75. Outer seal 191 seals bottom cover plate 135 to lower main plate 55.

Master connecting rod 82 has an enlarged inner end 190 with bore 192 therethrough. In a general analogy to conventional practice, master rod 82 is pivotally connected to crankshaft 75 with split bearing 193 residing in bore 192, and encircling main journal 77. Crankshaft 75 is segmented, end plate 87 being removable to expose journal 77. Therefore, in contrast to the prior art, inner end 190 of master connecting rod 82 is solid and passes over the free end of journal 77 during assembly.

Figures 11, 12:
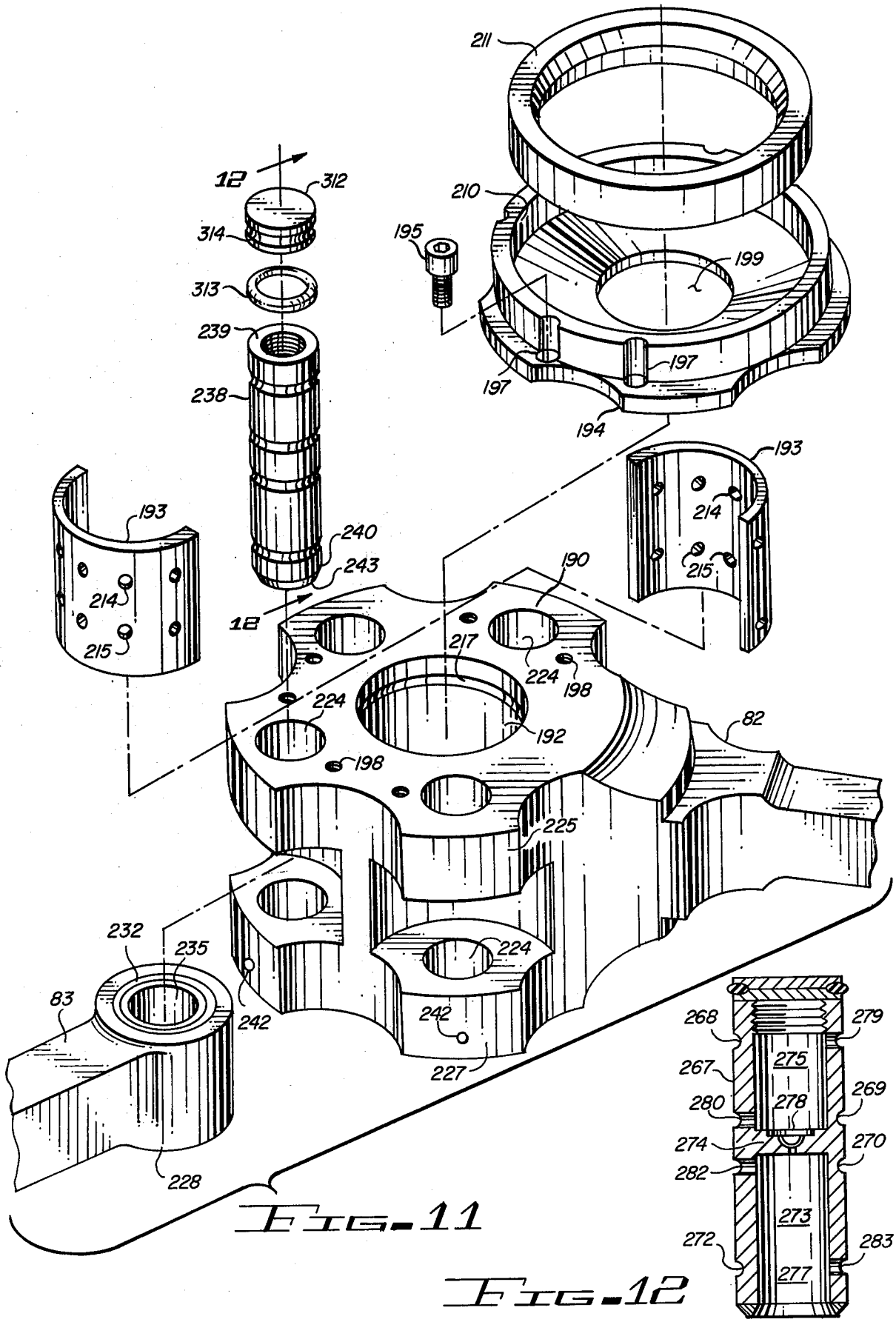
FIG. 11 is an exploded perspective view, partly broken away, of the inner end of the main connecting rod and the leaf connecting rod as seen in FIG. 4.
FIG. 12 is a vertical sectional view of the connecting pin which secures the leaf connecting rod to the main connecting rod taken along the line 12–12 of FIG. 11.

A retainer 194, as further seen in FIG. 11, is secured to either side of inner end 190 by bolts 195 which pass through openings 197 in retainer 194 and engage threaded apertures 198 in master rod 82. Each retainer 194 has a bore 199 therethrough which passes crankshaft 75 and a counterbore 210 which holds annular lip-type seal 211.

In accordance with the established practice for journalling bearings upon crankshafts, a spacing of a few thousandths of an inch exist between journal 77 and split bearing 193. Formed into journal 77 are first and second spaced apart annular grooves 212 and 213. Annular groove 212 communicates with primary supply channel 172 for inducing pressurized oil into the area between journal 77 and bearing 193. Oil from annular groove 212 passes between journal 77 and bearing 193 and enters annular groove 213 which communicates with primary return channel 175. Seals 211 retain oil within the selected area and prevent the escape of oil into the interior of crankcase 79.

Split bearing 193 has a first annular row of radially spaced openings 214 and a second circumferential row of radially spaced openings 215 which align with first annular groove 212 and second annular groove 213, respectively. Located within bore 192 are first and second annular channels 217 and 218, respectively. A portion of the oil entering annular groove 212 passes through opening 214 and enters annular channel 217. Similarly, communication is established between second annular groove 213 and second annular channel 218 through opening 215. Secondary supply channel 219 and secondary return channel 220 extend longitudinally through master connecting rod 82 for lubricating the area of the wrist pin by which a piston is attached to the other end of master connecting rod 82. The other end of connecting rod 82, and wrist pin and the piston, are not specifically illustrated herein. The arrangement is analogous to that associated with a leaf rod 83, which will be described in detail presently. Channel 222 extends longitudinally within bore 192 between annular groove 212 and supply passage 19 for the flow of pressurized oil. Similarly, oil from return passage 220 is conducted through longitudinal channel 223 to annular groove 213.

A plurality of secondary bores 224 extend through inner end of master rod 190. Secondary bores 224 are parallel to bore 192 and have axes which pass through a circle concentric with bore 192. For an engine of five-cylinder configuration, secondary bores 224 are spaced at 72°, with the two bores 224 nearest main connecting rod 82 being spaced 72° in either direction from the longitudinal axis of connecting rod 82. It is also noted that the section of inner end 190 through which each secondary bore 224 passes is bifurcated to provide a first and a second ear 225 and 227, respectively.

Each leaf rod 83, as further seen in FIGS. 13 and 14, has an inner end 228 and an outer end 229. Inner end 228 has a bore 230 extending therethrough in which resides anti-friction bearing 232. Outer end 229 includes anti-friction bearing 233 residing in bore 234. Bores 235 and 237 extend through bearings 232 and 233, respectively.

Inner ends 228 of leaf rods 83 are received between first ear 225 and second ear 227 associated with respective secondary bores 224. A connecting pin, having first end 239 and second end 240, is simultaneously received through bore 224 and bore 235 for pivotally securing each leaf connecting rod 83 to inner end 190 of master rod 82. A pin 242 is press fitted into an appropriate aperture in each second ear 227 to extend diametrically across bore 224. A groove 243 extends diametrically across second end 240 of each connecting pin 238. Pin 242 is received in groove 243 to stabilize connecting pin 238 against rotation relative master rod 82. Leaf rod 83 is pivotal with respect to connecting pin 238.

Piston 244, as illustrated in FIGS. 13, 15 and 16, analogous to a conventional piston, has outer cylindrical surface 245, top 247 and skirt 248 terminating with bottom edge 249. Upper and lower piston ring grooves 250 and 252, respectively, are formed in outer cylindrical surface 245 near top 247. Skirt 248 being generally hollow and thin-walled, is reinforced at diametrically opposed positions by bosses 253 and 254. Bore 255 extends diametrically through piston 244 within bosses 253 and 254. Hole 258 is drilled through piston 244 into bore 255 and has press fitted therein pin 258 which extends radially into bore 255. Annular grooves 259 are formed in bore 255 proximate either end thereof.

During assembly, outer end 229 of connecting rod 83 is closely received between bosses 253 and 254 of piston 244 with bore 237 in alignment with bore 255. Wrist pin 260, having first end 262 and second end 263, is slideably and rotatably received through bores 255 and 237. Radial groove 264 at second end 263 of wrist pin 260 engages pin 258 to prevent rotation of wrist pin 260 relative piston 244. During operation of the engine, as is known from conventional practice, connecting rod 83 oscillates relative piston 244. The movement for such oscillation is between wrist pin 260 and bearing 233.

Oil for the lubrication of bearing surfaces in connection with connecting pin 238 and wrist pin 260 is supplied through the passage 265 which communicates between first annular channel 217 and bore 244. It is understood that the device includes four passages 265, one communicating with each bore 224. Connecting pin 238, as seen with reference to FIGS. 11 and 12, has a cylindrical exterior surface 267 in which are formed first, second, third and fourth annular grooves 268, 269, 270 and 272, respectively. Bore 273 extends axially through connecting pin 238 and is divided at the approximate mid-point by partition 274, which divides the bore into first and second chambers 275 and 277, respectively. Orifice 278, in partition 274, cmmunicates between chambers 275 and 277. Passage 279 communicates between first groove 268 and first chamber 275, while passage 280 communicates between second annular groove 269 and first chamber 275. Similarly, passages 282 and 283 communicate between third annular groove 270 and fourth annular groove 272, respectively, and second chamber 277.

First and second annular grooves 268 and 269, respectively, and first chamber 275, comprise a portion of the oil supply route, while third and fourth grooves 270 and 272, respectively, and second chamber 277 are within the oil return path.

Oil from passage 265 is received in first annular groove 268 and entering through passage 279 fills first chamber 275. The oil, under pressure of oil pump 168, is forced from first chamber 275 through passage 280 into groove 269 for lubrication between connecting pin 238 and bearing 232. Passage 280 further communicates with tertiary supply conduit 284 extending longitudinally through leaf rod 83 and supplying oil to bearing 233 and wrist pin 260.

The following description of the lubrication of wrist pin 260 in connection with leaf rod 83 is analogous to the lubrication of the wrist pin associated with master connecting rod 82 and having oil supplied through supply passage 219. Bearing 233, such as also carried at the outer end of master connecting rod 82, includes first and second external annular grooves 285 and 287, respectively, and first and second internal annular grooves 288 and 289, respectively. Opening 290 communicates between first external groove 285 and first internal groove 288. Similarly, opening 292 communicates between second external groove 287 and second internal groove 289.

Oil supply conduit 284 extends through bushing 232, having inlet end 293 and discharge end 294. Discharge end 294 is spaced from first annular groove 245 and communicates therewith by means of longitudinal channel 295 formed in bushing 233. Thus, oil for lubrication of wrist pin 238 within bushing 233 is supplied from supply conduit 284 through channel 295 and groove 285 for discharge through opening 290. The oil then passes between bore 237 of bushing 233 and wrist pin 260 to second internal groove 289, where it then passes through opening 292 into second external groove 287. Tertiary return conduit 297 has an inlet end 298 which receives oil from groove 287 and an outlet end 299 which communicates with third annular groove 270 and subsequently through passage 282 into second chamber 277.

Bearing 233 further included first and second seal grooves 310 and 311, respectively. First seal groove 310 is outboard of first internal groove 288 and second seal groove 311 is outboard of second external annular groove 289. Annular seals, such as conventional O-rings, reside in grooves 310 and 311 to prevent the escape of oil from the designated area. Wrist pin 260 is retained within piston 244 by a snap ring on either end thereof held in respective annular grooves 259. Each connecting pin 238 is retained in the respective bore 224 by retainers 194 on either side of inner end 190 of master connecting rod 82. Retainers 194 also provide effective oil seals to prevent the discharge of oil from the outer ends of bores 224. Plug 312, carrying circular seal member 313 in groove 314 carried at first end 239 of connecting pin 238, provides additional sealing within bore 224 on the supply side, and, accordingly, the high pressure side, of connecting pin 238. Circular grooves 315 are formed in either end of bearing 232. Circular seals, such as conventional O-rings, are carried within the grooves and sealingly engage ears 225 and 227 to prevent the discharge of oil into crankcase 79.

Orifice 278 functions as a bypass to regulate the oil flow through passage 280. This prevents excessive pressure from being generated against the seals carried in grooves 315 and, further, the oil through supply conduit 284 to protect the seals carried in grooves 310 and 311. A further bypass for relief of pressure against the seals and grooves 310 and 311 is had by longitudinal channel 317 communicating between first and second external annular grooves 287 and 287.

All oil for lubrication of connecting pin 238 and wrist pin 260 eventually enters fourth annular groove 278 carried by connecting pin 238. Oil therefrom passes through passage 318 in enlarged end 190 of master rod 82 into second annular channel 218 in bore 192. Subsequently, the oil passes through openings 215 in split bearing 193 and second annular groove 213 in main journal 77 to primary return channel 275 extending through crankshaft 75.

THE FUEL/AIR INTAKE SYSTEM

Figure 6:
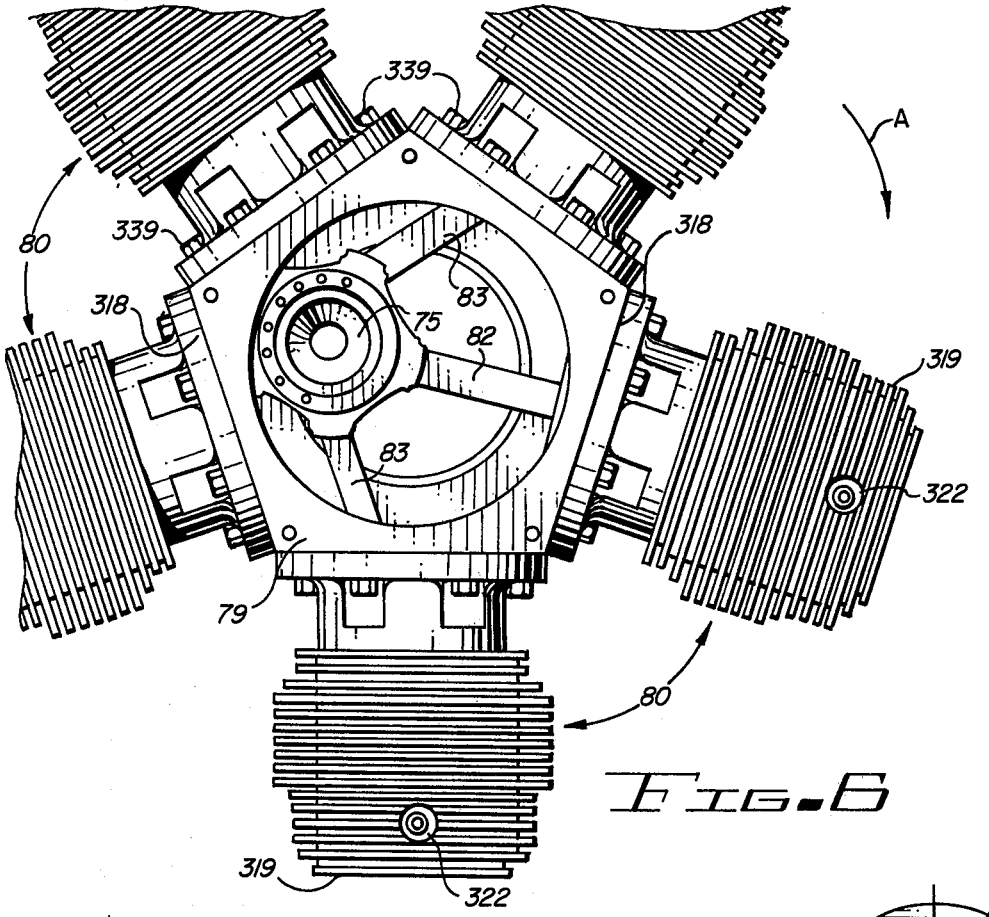
FIG. 6 is a plan view, partly broken away, of the crankcase of the instant invention, the top cover thereof being removed.
Figure 18:
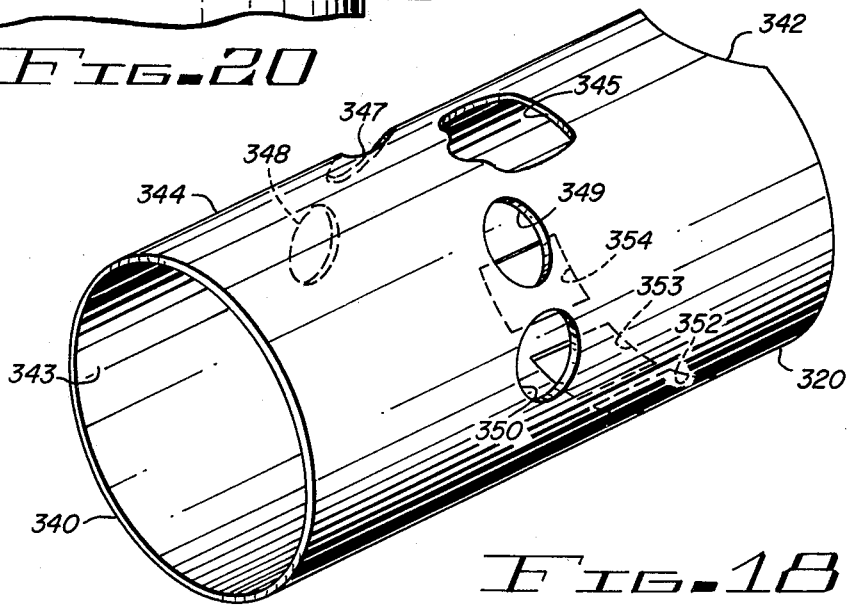
FIG. 18 is a perspective view of a liner useful in connection with the cylinder of FIG. 17.
Figure 21:
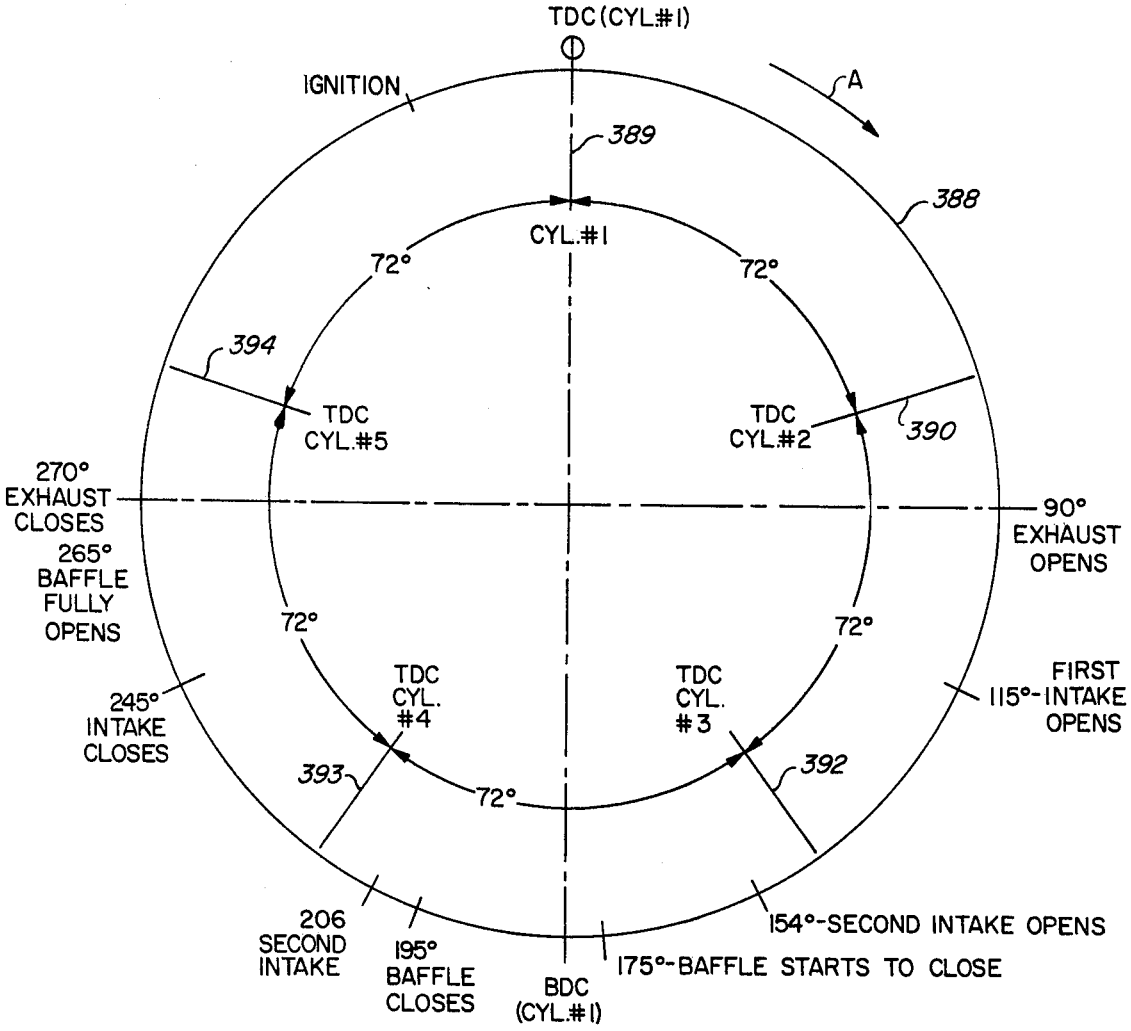
FIG. 21 is a schematic illustration setting forth the opening and closing of the several ports in the liner shown in FIG. 18.

The engine of the instant invention, in a preferred embodiment thereof, includes five cylinder assemblies 80. One cylinder assembly 80, as seen in FIG. 6, is secured to each side 318 of the pentagonal crankcase 79. Briefly, each cylinder assembly 80 includes a cylinder 319, a liner 320, as best seen in FIG. 18, and a piston 244, as previously described. For the purpose of saving weight, and other advantages as will be apparent to those skilled in the art, the cylinders 319 are fabricated of aluminum, as are the pistons 244. Liners 320 are constructed of ferrous metal. In the ensuing description, one cylinder assembly 80 will be described in detail, it being understood that the remaining cylinder assemblies 80 are identical.

A cylinder 319 will be first described in connection with FIGS. 6, 17, 19 and 20.

Cylinder 319 includes hollow cylindrical section 322 having inner and outer surfaces 323 and 324, respectively, open inner end 325 and closed outer end 327. Closed outer end 327 has a generally planer inner surface 328 with done-shaped recess 329 formed therein. Dome-shaped recess 329 is positioned off-center, being closer to surface 323 than the longitudinal axis of cylinder 319. Recess 329 functions as a combustion chamber, and for this purpose has a threaded aperture 330 which opens to exterior surface 324 for receiving spark plug 332, as further seen in FIG. 7.

Radial flange 333 extends outwardly from outer surface 324 at a location spaced from inner end 325. A plurality of radially spaced holes 334 extend through flange 333. As seen in FIG. 3, a cylindrical opening 335 is formed through each side 318 of crankcase 79. The axis of each opening 335 aligns with the longitudinal axis of a respective connecting rod 82 or 83. A plurality of threaded apertures 337 are formed through side 318 radially spaced around opening 335. The location of threaded apertures 337 corresponds with holes 334. Cylinder 319 has an inner terminal section 338 between inner end 325 and flange 333, which is sized to be received in a location fit within opening 335. Bolts 339 extend through holes 334 and threadedly engage apertures 337 to secure each cylinder 319 in respective position to crankcase 79.

Liner 320, having open inner end 340 and open outer end 342 is carried within cylinder 319. Liner 320 further includes inner cylindrical surface 343 and outer cylindrical surface 344. Outer surface 344 of liner 320 is sized to be locationally fitted within inner surface 323 of cylinder 319. Inner surface 343 of liner 320 is sized to slideably receive piston 244 in accordance with accepted practice and standard clearance.

Intake ports 345, 347, 348, 349 and 350 extend radially through liner 320. Exhaust ports 352, 353 and 354 also extend through liner 320. Intake port 345 is substantially aligned with threaded aperture 330. Intake ports 348 and 350 are diametrically opposed and equally spaced from intake port 345. Intake port 347 is intermediate intake ports 345 and 348 and, similarly, intake port 349 is at the approximate mid-point between intake ports 345 and 350. Exhaust ports 352 and 354 are equally spaced on either side of exhaust port 353.

Intake passages 355, 357, 358, 359 and 360 are formed in inner surface 323 of cylinder 319 and extend longitudinally thereof. The intake passages 355, 357, 358, 359 and 360, one side of which is formed by liner 320, communicate between the interior of the crankcase, and intake ports 345, 347, 348, 349 and 350, respectively. A flat 362 is formed on outer cylindrical surface 324 of cylinder 319 in the area of exhaust ports 352, 353 and 354. Exhaust passages 363, 364 and 365 are formed through cylindrical section 322 at flat 362 and align with exhaust ports 352, 353, and 354, respectively. Flat 362 accommodates annular exhaust manifold 367, as seen in FIG. 5. Exhaust passages 363, 364 and 365 communicate with exhaust manifold 367 for general purposes and function as described in the referenced patents.

Various relationships exist between the several ports located in liner 320. For purposes of orientation to facilitate an understanding of the ensuing operation of the engine, those relationships will now be generally described, it being understood that the relationships as immediately set forth are approximate and more specific relationships will become apparent as the description proceeds.

Referring to FIGS. 8, 9 and 10, there is seen a valve plate 368 which is generally in the shape of a sector of hollow circle. Valve plate 368 includes outer cylindrical surface 369, inner cylindrical surface 370, top surface 372, bottom surface 373, and leading and trailing edges 374 and 375. Arcuate recess 377, extending outwardly from inner arcuate surface 370 and downwardly from top surface 372, matingly receives end plate 87. Flathead bolts 378 are received through countersunk openings 379 in disc-like member 89 and engage threaded apertures 380 in valve plate 368 for securing valve plate 368 to end plate 87. The use of flathead bolts 378 and countersunk openings 379 preserve the flatness of upper surface 90 for receiving shaft extension 88 as previously described.

Valve plate 368 is stationary, being fixed to crankshaft 75. Cylinder block 78 rotates relative valve plate 368 in the direction of arrow A in FIGS. 9. Accordingly, relative cylinder block 78, edge 374 is the leading edge of valve plate 368, while edge 375 is the trailing edge. As particulary seen in FIG. 8, outer arcuate surface 369 has a height generally corresponding to the height of intake passage 355, with bottom surface 373 residing intermediate intake passage 355 and the adjacent intake passages 357 and 359, as illustrated by the broken line B in FIG. 19. Each cylinder 319 has an arcuate recess 382 formed therein corresponding to the arcuate outer surface 369 of valve plate 368. Accordingly, during operation, valve plate 368 sequentially passes through arcuate recess 382 of each cylinder 319 in sufficiently close proximity to function as a valve and prohibit flow through intake passage 355.

Primary intake passage 383, having inlet end 384, as seen in FIGS. 3 and 8, extends through crankshaft 75, including shaft extension 88 and end plate 87. Primary intake passage 383 communicates between carburetor air cleaner assembly 69 and the interior of crankcase 79. It is noted that primary intake passage 383 is set at an angle to direct the incoming fuel/air mixture away from main journal 77 and associated mechanism and in the direction of the cylinder assembly 80 currently passing through the intake cycle. (At the right in the illustration of FIG. 8.)

FIG. 16 illustrates a pin 387 radially carried by piston 244 within upper piston ring groove 250. A similar pin, not specifically herein shown, resides in second piston ring groove 252 at a position offset from first pin 387. Only a portion of each pin resides within the respective groove. The piston rings which reside in grooves 250 and 252 are provided with a mating notch, such that the ring cannot rotate during operation, as is the normal tendency. It is well known that piston rings have an end gap which is formed between the ends of the ring. Rings are also biased to be expansive. To prevent the ends of the piston ring, adjacent the end gap, from expanding into an intake or exhaust port, the rings are locationally notched to fix the end gap into a continuous area of liner 320 between ports.

The engine cycle is best described in connection with FIGS. 21 and 22–31. During one complete revolution of cylinder block 78, each cylinder assembly 80 passes through a complete cycle, including the sub-cycles of intake and exhaust, power and compression. As will be appreciated by those skilled in the art, the circle designated 388 represents one complete cycle, 360° rotation, of cylinder 1. Zero degrees (0°) at the top of the circle represents top dead center of cylinder 1 and diametrically opposed at 180° is bottom dead center of cylinder 1. Functions which occur during the cycle of cylinder 1 are indicated at the appropriate degree increment of circle 388. For references, lines 389, 390, 392, and 394 extending inwardly from circle 388 represent the spacing of cylinders 1, 2, 3, 4 and 5, respectively. Each cylinder is spaced at 72°. Additional circles corresponding to circle 388 could be drawn for each cylinder, with the 0°, or top dead center of the respective cylinder, being at the respective line. Various ones of the increments of circle 388 correspond to the schematic views presented in FIGS. 22–31, as will be discussed as the description ensues.

For the purposes of orientation and to facilitate an understanding of the ensuring description, certain relationships concerning the arrangement of the intake ports and exhaust ports of sleeve 320 will first be made. (FIG. 18) Intake ports 347, 348, 349 and 350 are substantially identical in size and configuration and lie at substantially the same position relative the longitudinal axis of liner 320. The respective outermost edge, (i.e., the edge nearer outer end 342) of each intake port 347, 348, 349 and 350, lies at the approximate mid-point of sleeve 320 intermediate outer end 342 and inner end 340. The inner edge, (i.e., the edge nearer inner end 340) of intake port 345, is generally aligned with the outer edge of the intake port previously described. The outer edge of intake port 345 is spaced therefrom in a direction toward outer end 342. Exhaust ports 352, 353 and 354 are generally rectangular and aligned. The inner edge of each exhaust port 352, 353 and 354 is at the approximate longitudinal mid-point of intake port 345. The outer edge of intake port 345 is at the approximate longitudinal mid-point of the exhaust ports 352, 353 and 354. It is understood that the foregoing relationships are set forth in approximation, and the precise relationships will become apparent presently.

Figure 22:
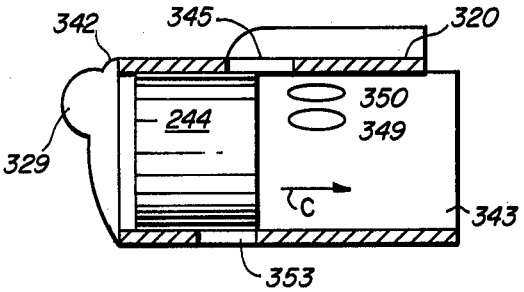
FIG. 22 is a semi-schematic view representing a vertical sectional view of a piston and cylinder assembly of the internal combustion engine of the instant invention, the piston being at top dead center immediately after ignition.

FIG. 22 represents cylinder No. 1 at 0°, otherwise known as top dead center. Corresponding to established internal combustion engine practice, piston 244 is moving in the direction of arrow C and is in the power stroke, ignition having occurred previously. Crankshaft 75 being fixed, the power stroke urges rotation of cylinder block 78. In the immediate position, piston 244 is near outer end 342 of liner 320, being above intake ports 347, 348, 349 and 350 and partially past intake port 345. The ports are therefore considered closed. Exhaust ports 352, 353 and 354 are likewise closed, being opposite outer cylindrical surface 245 of piston 244 and inboard from the present location of the piston rings carried in grooves 250 and 252. For purposes of reference, the position of the piston during movement will be referenced by the junction between outer cylindrical surface 245 and top 247. In the instant position, the piston, as defined, resides near outer end 342 of liner 320. The chamber is considered to be that volume within liner 320 between piston 244 and outer end 342.

Figure 23:
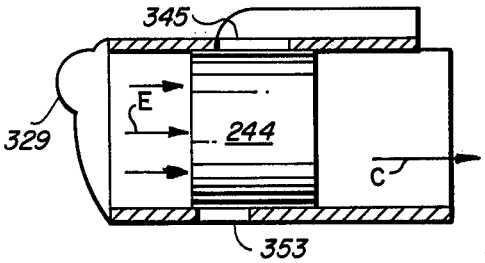
FIG. 23 is a view generally corresponding to the view of FIG. 22, but at a later time which is the beginning of the opening of the exhaust ports.

FIG. 23 is taken at 90°, wherein the opening of exhaust ports 352, 353 and 354 is imminent. During the initial 90°, the expanding gases of combustion are equalized within the chamber and exert pressure, driving piston 244 in the direction of arrow C. At the beginning of the opening of the exhaust ports, FIG. 24, the direction of flow of the exhaust gases begin to turn and excape through the open ports, as represented by the arrowed lines E.

Figure 24:
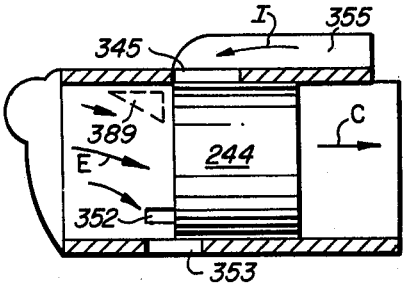
FIG. 24 is another view generally corresponding to the view of FIG. 22 taken at a time subsequent to the view of FIG. 23 at which time the piston commences to uncover the intake port.

Intake port 345 is about to open at 115°, as seen in FIG. 24. During the 25° duration during which the exhaust ports 352, 353 and 354 have been open, a pattern of flow of the exhaust gas has been established. As seen by the arrowed lines E of FIG. 24, all exhaust gas is now moving in a direction toward the open exhaust ports. The movement, as seen by the arrowed lines E, is away from the side of the chamber opposite the exhaust ports, tending to create a low pressure area in the region designated by broken line triangle 389. Intake mixture, moving in the direction of arrowed line I, initially enters the area designated by the broken line triangle 389. A stratification of gases results, with minimal pollution of the intake gases by the exhaust gases.

Figure 25:
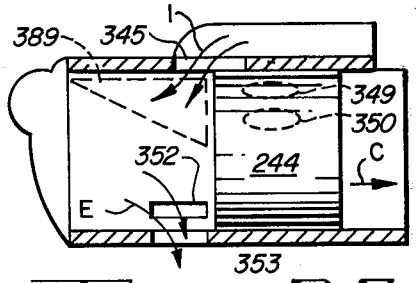
FIG. 25 is yet another view generally corresponding to the view of FIG. 22 and at a time subsequent to the view of FIG. 24, at which time the intake and exhaust ports are open.

During the subsequent 39° of dwell, as piston 244 moves moves in the direction of arrow C, as seen in FIG. 25 taken at 154°, the exhaust gases continue to escape, while intake mixture continues to enter. The area vacated by the exhaust gases continues to increase in volume, as indicated by the enlarged broken line triangle 389 in FIG. 25. At this point, the space available to receive intake mixture has increased and can now accept additional intake mixture. Accordingly, intake ports 347, 348, 349 and 350 commence opening.

Figure 26:
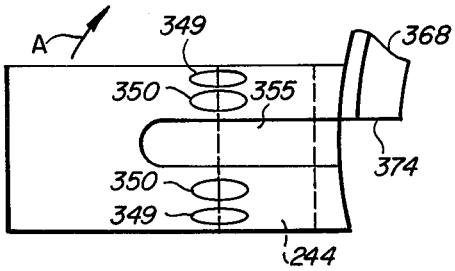
FIG. 26 is semi-schematic plan view generally corresponding to the view of FIG. 25.

At 175°, as seen in FIG. 26, all intake ports and exhaust ports are fully open. The rotation of cylinder block 78 has brought intake passage 355 adjacent the leading edge 374 of valve plate 368. At this point, intake passage 355 is fully open.

Figure 27:
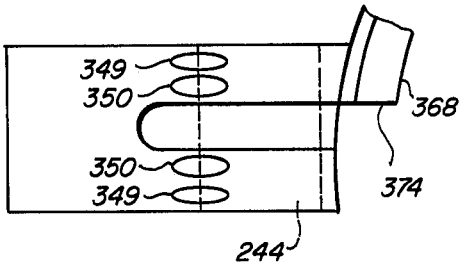
FIG. 27 is a view generally corresponding to the view of FIG. 26 and at a time subsequent thereto as the valve plate as seen in FIG. 10 closes the intake port.

At 180°, piston 244 passed through bottom dead center and begins the return stroke, compression cycle, in the direction of arrow D. Intake mixture continuous to enter through intake ports 347, 348, 349 and 350, as exhaust gas continues to escape through exhaust ports 352, 353 and 354. The area of the chamber adjacent intake port 345, having received the initial and the longest duration of intake mixture, approaches a state of equilibrium, which has substantially curtailed the flow through intake passage 355. Further movement of piston 244 in the direction of arrowed line D will tend to expel the intake mixture through intake port 345, urging a return flow through intake passage 355 into crankcase 79. Several degrees of movement of piston 244 in the direction of arrow D are required to initiate the discharge of the intake mixture through intake passage 355. At 195°, as seen in FIG. 27, 15° past bottom dead center, leading edge 375 has swept across intake passage 355, which is now closed by valve plate 368.

Figure 28:
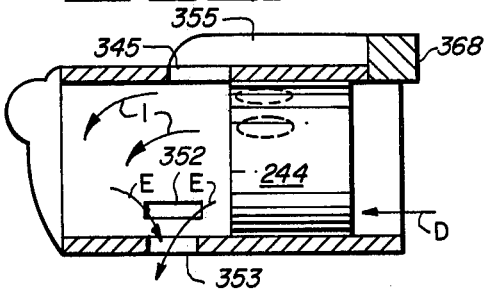
FIG. 28 is a view generally corresponding to the view of FIG. 22 and taken subsequent to the time of the view of FIG. 27 at which time the piston has begun moving in the compression stroke.
Figure 29:
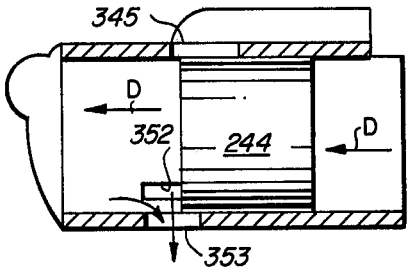
FIG. 29 is an illustration generally corresponding to the view of FIG. 28 and at a time subsequent thereto as the piston moves past the intake port.

As 206°, as seen in FIG. 28, intake ports 347, 348, 349 and 350 are closed by piston 244. Intake port 355 is closed by reason of valve plate 368. Exhaust ports 352, 353 and 354 are fully open. At 245°, as illustrated in FIG. 29, intake port 345 is closed by piston 244. Exhaust ports 352, 353 and 354 are partially closed. The last of the exhaust gases escape through the rapidly closing exhaust ports.

Figure 30:
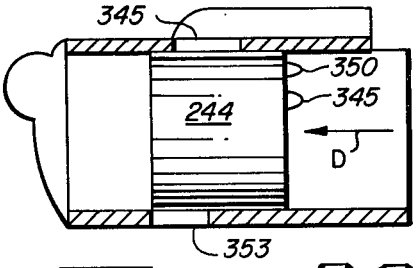
FIG. 30 is a view generally corresponding to the illustration of FIG. 29 and at a later time as the piston moves past the exhaust port.

At 270°, as seen in FIG. 30, exhaust ports 352, 353 and 354 are fully closed. The intake mixture is now completely captive within the chamber and the piston, continuing movement in a direction of arrowed line D, urges final compression of the mixture prior to ignition. At 265°, the trailing edge 375 of valve plate 368 passed from intake passage 355.

Figure 31:
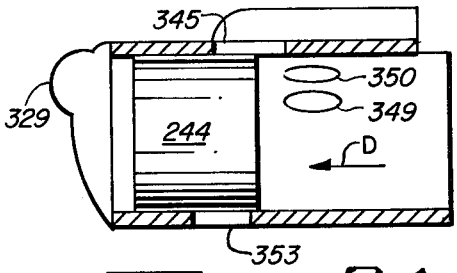
FIG. 31 is a further schematic illustration generally corresponding to the view of FIG. 30 and viewed at a subsequent time as the piston approaches top dead center.

Piston 244 continues movement in the direction of arrow D until the position indicated in FIG. 31. The intake mixture is compressed and ignited by a spark plug, the tip of which resides in recess 329. As will be appreciated by those skilled in the art, piston 244 has not reached 0° or stop dead center. In the engine of the instant invention, ignition occurs in a range of approximately from 350° to 356°, or 4° to 30° before top dead center, depending upon speed of rotation of the engine and other factors, as will be readily understood by those skilled in the art.

THE SPARK PLUG RETAINER

Figure 7:
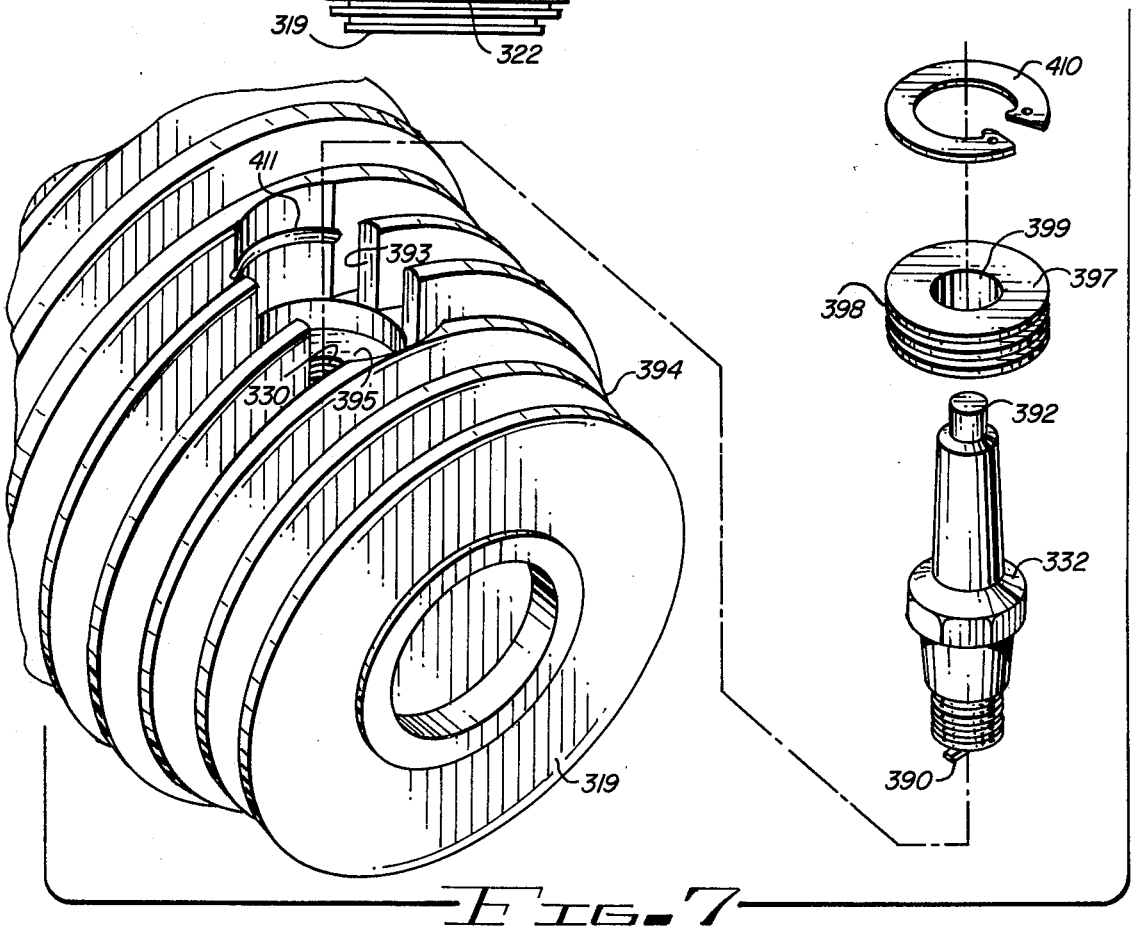
FIG. 7 is a partial perspective view of the outer end of one of the cylinders seen in FIG. 6, the spark plug and retainer assembly being shown in exploded perspective.
Figure 17:
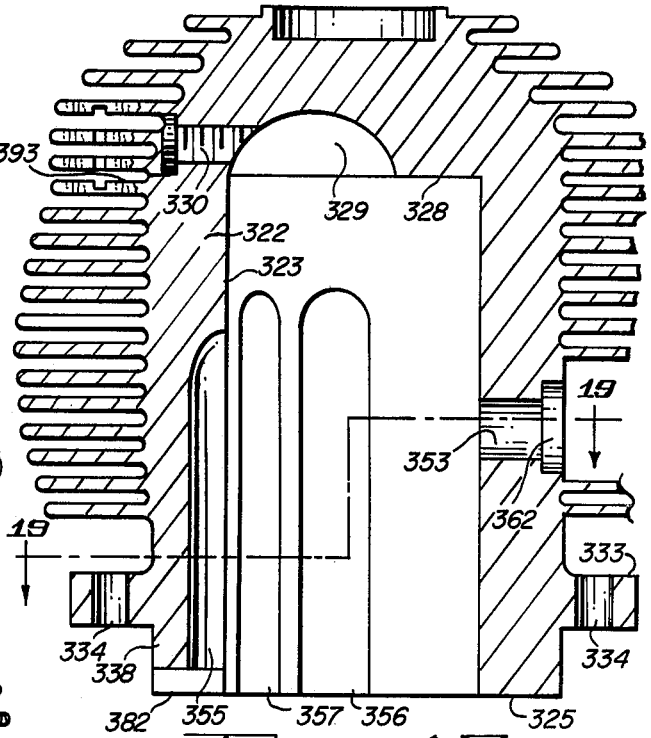
FIG. 17 is a vertical sectional view of a cylinder as seen in FIG. 6, the cylinder being cut along the vertical axis thereof.

As seen in FIGS. 7 and 17, threaded aperture 330 extends through hollow section 322 of cylinder 319 into dome-shaped recess 329. Conventional spark plug 332 is engaged with threaded aperture 330 in accordance with conventional practice. Spark plug 332 has a firing tip 390 at one end thereof, and a terminal 392 at the other end thereof. Firing tip 390 extends into recess 329 for the purpose of igniting the intake mixture at the appropriate time. Terminal 392 receives an appropriately timed electrical impulse from the ignition ring, as described in the referenced patents. The ignition ring communicates with distributor 65 through electrical lead 69.

Threaded aperture 330 has a counterbore 393 extending inwardly through cooling pins 394 and terminating with surface 395 in hollow section 322. Ring-shaped member 397, having annular cooling fins 398, is sized to be received within counterbore 393 and rest upon surface 395. Bore 399 extends through ring-shaped member 397 and receives the upper portion of spark plug 392. Snap ring 410 of the internal type is received in snap ring groove 411 within counterbore 393 for retaining ring-shaped membr 397. Ring-shaped member 397 provides two functions: dissipation of heat from spark plug 332 and retention of spark plug 332, should the spark plug loosen due to vibration.

THE EXHAUST SYSTEM

Figure 19:
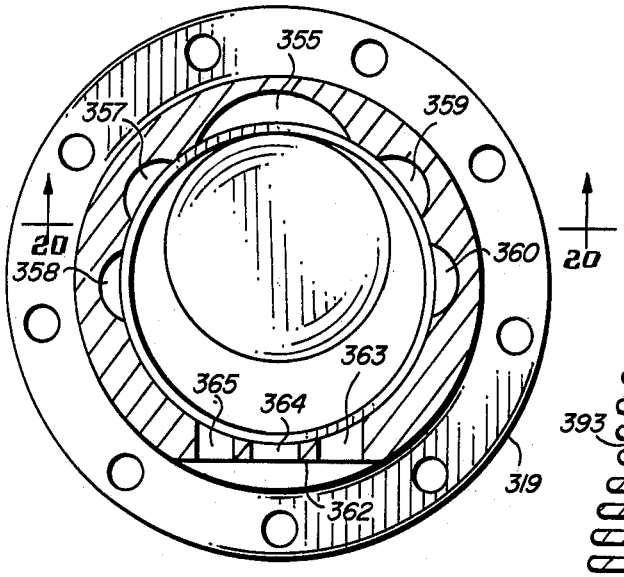
FIG. 19 is an offset sectional view taken along the line 19–19 of the cylinder of FIG. 17 and having the liner of FIG. 18 in place therewith.
Figure 20:
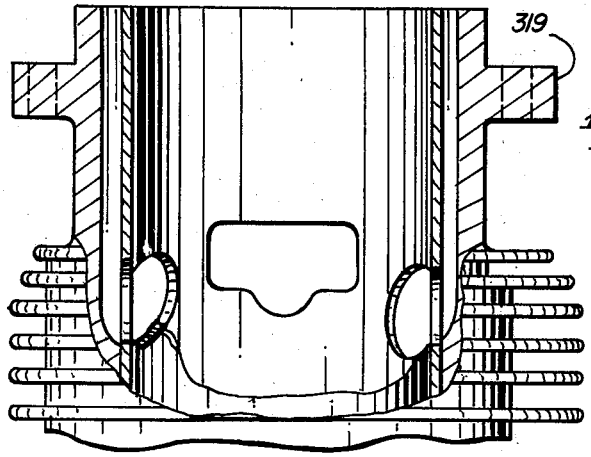
FIG. 20 is a longitudinal sectional view, partly broken away, taken along the line 20–20 of FIG. 19.

Exhaust passages 352, 353 and 354 in liner 320 communicate with the exhaust passages 363, 364 and 365, respectively, in cylinder 319, as viewed in FIG. 19. As seen also in FIG. 5, exhaust passages 363, 364 and 365 are located at flat 362 formed across each cylinder 319 and oriented to face downwardly. Accordingly, it is seen that the intake of air-fuel mixture generally occurs in the upper portion of each cylinder 319, while the exhaust gases are generally discharged vertically downward.

Figure 33:
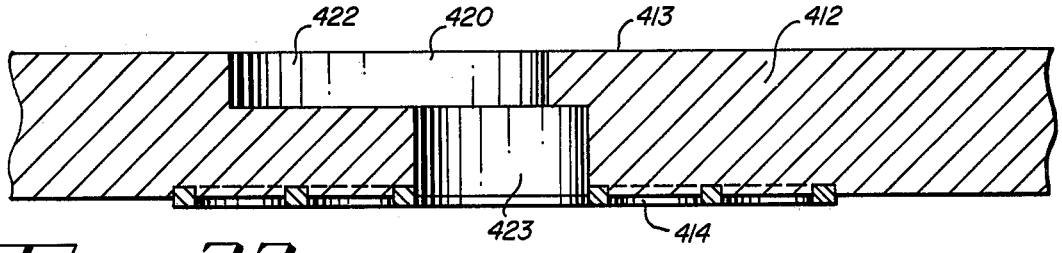
FIG. 33 is an enlarged fragmentary vertical sectional view of the exhaust ring taken along the line 33–33 of FIG. 5.

Referring now more specifically to FIGS. 5 and 33, there is seen an angular exhaust ring 412, having top surface 413, bottom surface 414, outer edge 415 and inner edge 417. Top surface 413 of exhaust ring 412 rests against the flat 362 of the several cylinders 319. Cap screws, not specifically shown, pass through apertures 418 in exhaust ring 412 and threadedly engage threaded apertures 419 in each cylinder 319 for securing exhaust ring 412 to the several cylinders 319. Counter-bored apertures 418 receive the heads of the cap screws such that bottom surface 414 of exhaust ring 412 is unobstructed.

Several intermediate exhaust passages 420, one corresponding to each cylinder 319, pass through exhaust ring 412 between top surface 413 and bottom surface 414. Each exhaust passage 420 includes a first opening 422 extending inwardly from top surface 413 which is sized and shaped to embrace and communicate with exhaust passages 363, 364 and 365. To prevent the excape of exhaust gases, top surface 413 of exhaust ring 412 is sealed against flat 362 of each cylinder 319. The sealing may be accomplished by accurate machining, the use of commercially available gasket compounds or a separate gasket element fabricated from commercially available gasket material. First opening 422 is elongate. Intermediate exhaust passage 420 further includes a second generally cylindrical opening 423 extending inwardly from bottom surface 414. First and second openings 422 and 423 meet and are open one to the other intermediate top and bottom surfaces 412 and 414, respectively.

Figure 34:
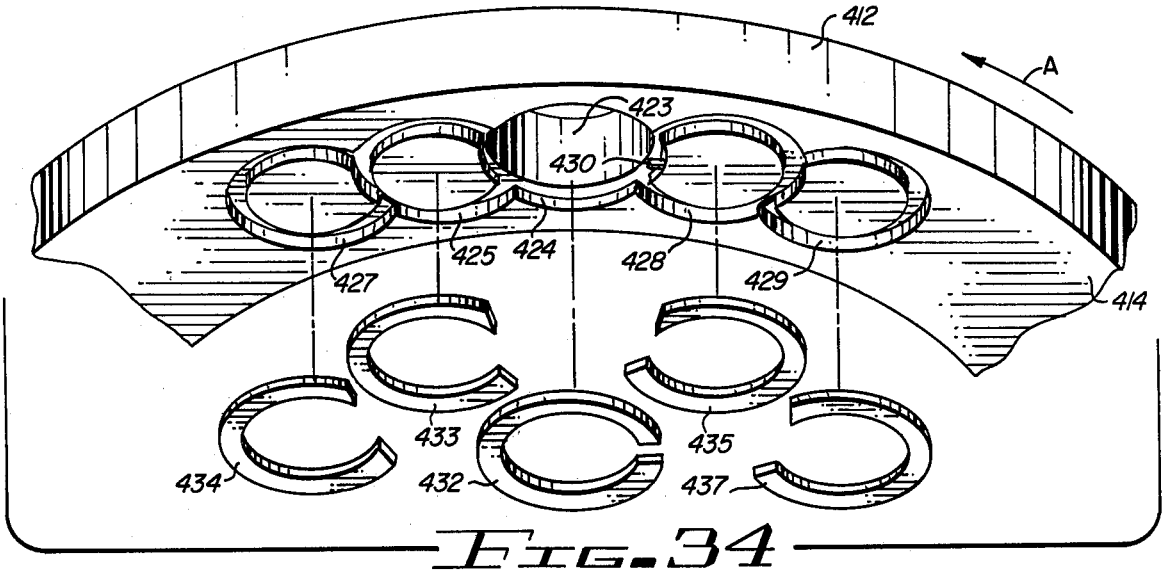
FIG. 34 is an exploded bottom perspective view of that portion of the valve ring seen in FIG. 33.

One annular groove 424 and four semi-annular grooves 425, 427, 428 and 429, as seen in FIG. 34, are formed in exhaust ring 412 extending inwardly from bottom surface 414. Annular groove 424 is concentric with second opening 423 of intermediate exhaust passage 420. Oriented relative the direction of rotation of exhaust ring 412, as illustrated by arrowed line A, semi-annular grooves 425 and 427 lead annular groove 424, while semi-annular grooves 428 and 429 follow annular groove 424. It is noted that the ends of each semi-annular groove are open to the adjacent respective groove. A pin 430 extends radially inward from the outer surface of annular groove 424.

Seals 432, 433, 434, 435 and 437 are carried in grooves 424, 425, 427, 428 and 429, respectively. While the seals may be fabricated of various materials, satisfactory service has been achieved with seals fabricated of cast iron. Preferbly, each seal is elastically expansive. When compressed, by moving the ends of a respective seal toward each other, the seal assumes the shape of the respective groove and is readily insertible therein. The ends of split angular seal 432 reside on opposite sides of pin 430 to prevent rotation of the seal. The ends of the other seals abut the respective adjacent seal to prevent rotation. The utility of the foregoing seal arrangement will be described in detail presently.

Exhaust ring 412, being attached to the several cylinders 319, is a rotating component and may, for purposes of orintation, be considered to be a portion of the cylinder block assembly. Exhaust manifold 367 is stationary, being a part of outer housing 50. Exhaust manifold 367, as seen in FIG. 5, includes annular exhaust plate 438 which cooperates with exhaust ring 412 to establish valve timing. Exhaust plate 438, exhaust ring 412 and the previously described exhaust openings in liner 320 and in cylinder 319 broadly comprise exhaust means for the instant engine.

Figure 32:
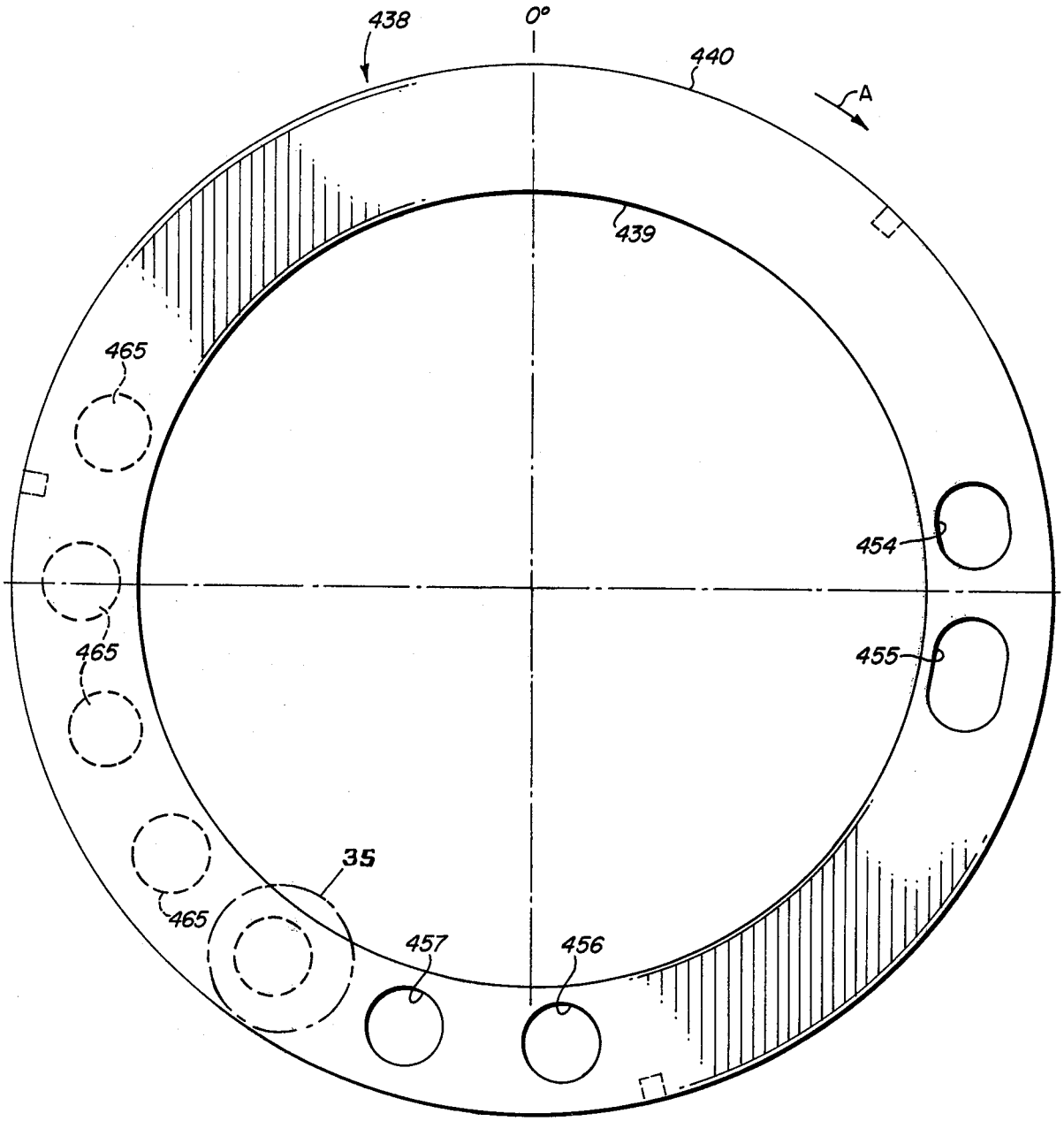
FIG. 32 is a top plan view of the exhaust ring as seen in FIG. 5.

Exhaust plate 438, as also seen in FIG. 32, has an inner peripheral edge 439, outer peripheral edge 440, top surface 442 and bottom surface 443. Annular groove 444, formed in lower main plate 55, having bottom 445, inner side wall 447 and outer side wall 448, receives exhaust plate 438. A locational fit exists between valve plate 438 and groove 444, that is, exhaust plate 438 is movable within groove 444; however, clearances are minimal.

A plurality of angularly spaced pins 449 are press fitted into exhaust plate 438 and extend radially from outer surface 440. A plurality of recesses 450, one corresponding to each pin 449, are formed in outer side wall 448 of annular groove 444. Pins 449 are closely received within the respective recesses 450 to prevent rotation of exhaust plate 438 within groove 444. Recesses 450 are elongated in a vertical direction and provide for vertical sliding movement of exhaust plate 438 within groove 440. A plurality of compression springs 452 are spaced about groove 444, each being carried in a socket 453 and extending upwardly from bottom 445. Springs 452 bear against bottom surface 443, urging exhaust plate 438 upwardly toward exhaust ring 412 and maintaining top surface 442 in sealing engagement with seals 432, 433, 434, 435 and 437.

Four exhaust outlets 454, 455, 456 and 457, are formed through exhaust plate 438. Exhaust pipe 458 depends from exhaust plate 438 and communicates the exhaust outlet 454. Exhaust pipe 459 communicates with exhaust opening of 455 and depends from exhaust plate 438. Similarly, exhaust pipes 460 and 461 depend from plate 438 and communicate with exhaust outlets 456 and 457, respectively. Exhaust pipes 458, 459, 460 and 461 extend downwardly through openings 462, 463, 464 and 464*a*, respectively, in the bottom 445 of groove 444 and through lower main plate 55. Annular seals 466 reside in appropriately sized grooves and sealingly engage the several exhaust pipes within the respective openings in plate 55. Exhaust pipes 462, 464 and 464*a* are for purposes of exhaust gas return and, accordingly, communicate through exhaust conduit 76 with carburetor and air cleaner assembly 69. Exhaust pipe 459 is an exhaust in the conventional meaning of the word, and, accordingly, is vented to atmosphere through a conventional system which generally includes a muffler.

In accordance with the immediate embodiment of the invention, exhaust outlet 457, as viewed at top surface 442 of exhaust plate 438, FIG. 32, is circular. Exhaust outlets 454 and 455 are elongate in the arcuate direction. In a preferred embodiment, exhaust outlet 454 is elongated by approximately 12%, while exhaust outlet 455 is elongated by approximately 50%.

The leading edge of each exhaust outlet 454, 455, 456, and 457 is defined as that point of the opening which is the closest to top dead center or 0°, as previously noted in connection with FIG. 9. For purposes of orientation, 0° is noted on FIG. 32 and is counter-clockwise from the exhaust outlets. The leading edge of exhaust outlet 454 is at 77°, leading edge of exhaust outlet 455 is located at 94° and the leading edge of 456 is located at 170°. Exhaust outlet 457 is spaced from outlet 456 by 11°. Exhaust ring 412 moves relative exhaust plate 438 in the direction of rotation, as indicated by the arrowed line A.

The exhaust system, as set forth above, including the inner action of exhaust ring 412 and exhaust plate 438, cooperates with certain portions of the engine previously described in detail in connection with the fuel air intake system. Especially significant is the function of piston 244 for the movement of gases within cylinder 319 and the opening and closing of exhaust ports 352, 353 and 354, as set forth with reference to FIG. 21. At approximately 77° after top dead center, second opening 423 of intermediate exhaust passage 420 aligns with the leading edge of exhaust outlet 454. At this time, exhaust ports 352, 353 and 354 are closed as a result of the previous intake stroke in the late closing of exhaust ports 352, 353 and 354. Unburned fuel air mixture, under pressure, resides within intermediate exhaust passage 420 and in exhaust passages 363, 364 and 365 in cylinder 319. As communication is established between opening 423 and exhaust outlet 454, the unburned gases escape through exhaust pipe 458 for recycling to carburetor and air cleaner assembly 69. This is a portion of the exhaust gas return system for subsequent reburning of previously partially burned gases.

The trailing edge of exhaust outlet 454 is located at approximately 88°. As opening 423 approaches the trailing edge of exhaust passages 454, closing begins. At 90°, exhaust ports 353, 354 and 355 commence opening and the initial gases of combustion rush into exhaust passages 363, 364 and 365 and continue into intermediate exhaust passage 420, pushing the final unburned gas through exhaust outlet 454.

As will be recognized by those skilled in the art, the initial gases of combustion are relatively clean, free of unburned hydrocarbons and environmentally non-pollutant. At approximately 94°, at which time all unburned gases have been purged from the volume defined by exhaust passages 363, 364 and 365, and intermediate exhaust passage 420 and said passages are filled with initial gases of combustion, passage 423 reaches the leading edge of exhaust outlet 455 and the thoroughly burned gases begin escaping through the environmentally vented exhaust system. At approximately 108°, opening 423 approaches the trailing edge of exhaust outlet 455 and closing begins.

As previously noted, intake port 345 begins opening at 115°. At approximately this time, opening 423 passes exhaust outlet 455, closing said exhaust outlet. The intermediate products of combustion, those which have been thoroughly burned, have been discharged through exhaust pipe 459. The final products of combustion, which are not thoroughly burned, are at this time moving into exhaust passages 363, 364 and 365 and intermediate exhaust passsge 420. At 170°, opening 423 approaches the exhaust outlet 456 and the final products of combustion enter the exhaust gas return system for recombustion. Exhaust outlet 457 also receives final products of combustion.

As opening 423 passes across exhaust outlet 456 and 457, intake port 345 continues to open and the final products of combustion are succeeded by incoming fuel-air mixture. During the final phases of closing of exhaust outlet 457, the combustion chamber is purged of exhaust gases by the incoming fuel-air mixture. The final products of combustion along with a small amount of fresh fuel-air mixture now reside in exhaust passages 363, 364 and 365 and intermediate exhaust passage 420. This is the mixture, as previously described, which is initially discharged through exhaust outlet 454.

Figure 35:
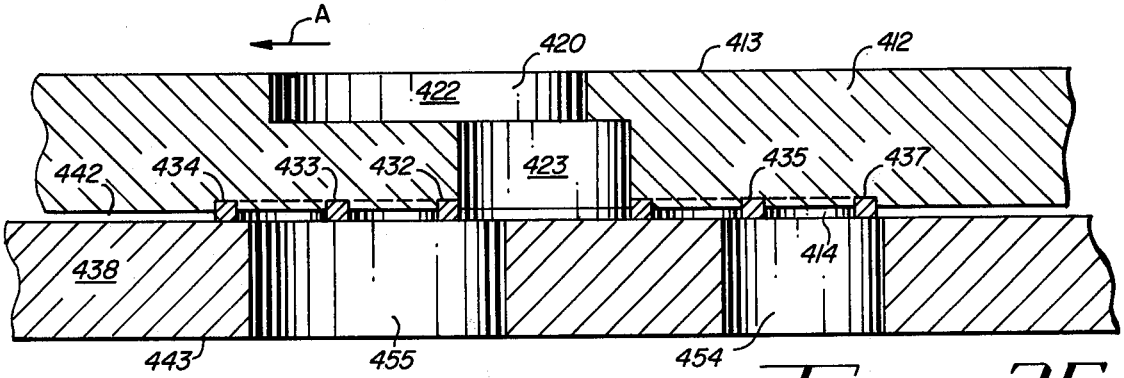
FIG. 35 is a vertical sectional view of the valve ring generally corresponding to the view of FIG. 33, and further including a vertical sectional view of a portion of the exhaust plate seen in FIG. 32.

The function of the seal arrangement, as previously described in connection with FIG. 34, is best explained in connection with FIG. 35. As exhaust ring 412 moves relative exhaust plate 438, opening 423 has a dwell time in which the leading and trailing edges thereof intersect the opening of the various exhaust outlets. For purposes of immediate illustration, exhaust outlet 455 is shown and is exemplary of exhaust outlets 454, 456 and 457. During this time outlet 455 resides on the inside and the outside of seal 432. Exhaust gas is therefore free to escape around seal 432. The exhaust gas is prevented from escaping to the interior of the engine and to the environment by additional seals 433, 434, 435 and 437. It is noted that the terminal seals 434 and 437 are at a sufficient distance from opening 423 such that exhaust outlet 455 is at all times sealed when in communication, either partial or complete, with outlet 423.

Figure 36:
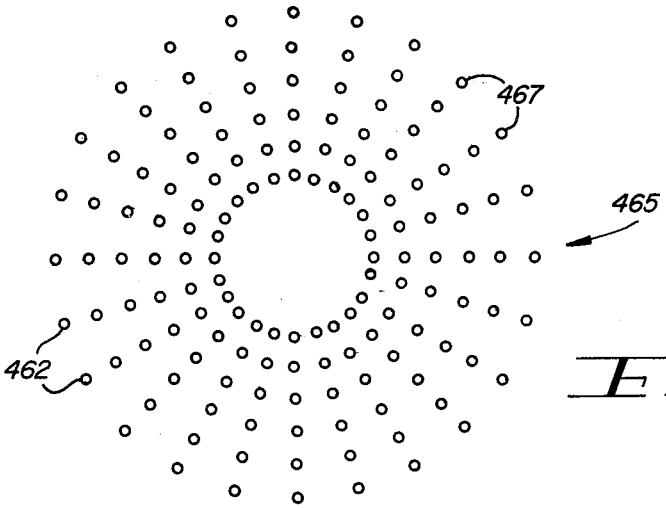
FIG. 36 is an enlarged fragmentary view of a portion of the valve plate of FIG. 32 as indicated by the broken line circle 36.

Commencing at approximately 210° is a pattern of periodically spaced seal lubricating elements 465, as seen in FIG. 32. As more clearly seen in FIG. 36, each seal lubricating element includes a plurality of blind holes 467 formed in top surface 442 of exhaust plate 438. In accordance with an immediately preferred embodiment of the invention, each blind hole 467 has a diameter of approximately 0.30 inches and a depth of approximately 0.060 inches. The holes 467 are arranged in six angular rows, each having 24 holes.

As previously noted, the fuel air mixture includes a trace amount of oil or other lubricating fluid for the express purpose of lubricating the piston rings. Preferably the lubricating fluid is in the ratio of 1 part to 100–150 parts of fuel. Also, as previously noted, a small amount of fuel-air mixture resides within intermediate exhaust passage 420. During the dwell between the closing of exhaust outlet 457 and the approach to element 465, turbulence within intermediate exhaust passage 420 has stilled and the lubricating fluid begins to settle out. The settling lubricating fluid enters and is retained within holes 467. Seals 432, 433, 434, 435 and 437 are lubricated during the passage over holes 467. The transfer of lubricating fluid from holes 467 to the seals will be appreciated by those skilled in the art. It will also be appreciated that were holes 467 not present, and the lubricating fluid free to fall upon the top surface 442 of exhaust plate 438, said lubricating fluid would be wiped therefrom by the seals. As previously noted, exhaust ports 352, 353 and 354 finally close at 270°. The terminal seal lubricating element 465 is positioned subsequently.

Various changes and modifications to the embodiments herein chosen for purposes of illustration will readily occur to those skilled in the art. To the extent that such modifications and variations do not depart from the spirit of the invention, they are intended to be included within the scope thereof, which is limited only by a fair interpretation of the appended claims.

Having fully described and disclosed the present invention and preferred embodiments thereof in such clear and concise terms as to enable those skilled in the art to understand and practice same, the invention claimed is:

1. In an internal combustion engine including a stationary crankshaft having an axially offset portion between its ends; a rotating crankcase journalled about said crankshaft and enclosing said offset portion of the crankshaft; a plurality of cylinders mounted on said crankcase in angularly spaced relation; a piston received in each of said cylinders; and a connecting rod for each piston having one end pivotally connected to its piston by a wrist pin and the other end pivotally connected to said offset portion of the crankshaft, the improvements consisting of:

(a) a closed pressurized lubricating system for the journalled relation of said crankcase to said crankshaft; the pivotal mounting of said wrist pins in said cylinders, and the journalled relation of said connecting rods to said offset portion of said crankshaft;

(b) a fuel inlet portion in each of said cylinders and a stationary valve plate operatively associated with each of said fuel inlet portions;

(c) a spark plug for each cylinder and a retainer for each of said spark plugs, said retainer taking the form of a snap ring which, in addition to maintaining its spark plug in assembled relation on its cylinder, dissipates heat from that spark plug; and (d) a plurality of exhaust ports in each cylinder, together with a valve associated with each of said exhaust ports, one of said exhaust ports being a primary port which communicates with an environmental exhaust system and receives the initial gases of combustion.

2. In an internal combustion engine including a stationary crankshaft, a plurality of angularly spaced pistons mounted on and extending radially from said crankshaft; a crankcase journalled on and rotatable about said crankshaft; a plurality of angularly spaced cylinders, each having an open end a closed end formed with combustion chamber on its inner face each of said cylinders carried by said crankcase and corresponding in number and arrangement to said pistons, with each piston being reciprocal in a cylinder; means for delivering a fuel mixture to each of said cylinders, an improved fuel intake comprising:

(a) a main fuel inlet in each of said cylinders connecting with the combustion chamber therein; and (b) an arcuate valve plate mounted on, extending radially from, said crankshaft, and cooperating with the main fuel inlets of said cylinders in succession as said crankcase rotates to vary the effective sizes of said main fuel inlets and thus control the amount of fuel delivered to said combustion chambers.

3. The fuel intake of claim 2, together with a plurality of auxiliary fuel inlets arranged symmetrically with respect to said main fuel inlet.

4. The fuel intake of claim 3, together with a liner locationally fitted in each of said cylinders and cooperating therewith to define said main fuel inlet.

5. The fuel intake of claim 4, together with a liner locationally fitted in each of said cylinders and cooperating therewith to define said fuel inlets.

6. The fuel intake of claim 5 in which said auxiliary fuel inlets terminate in said liner at levels closer to the open end of said cylinder than said main inlet.

7. The fuel intake of claim 2 in which said crankshaft includes an end plate at one end formed with a fuel intake passage that diverges away from the axes of the crankshaft in an inward axial direction and communicates between said fuel mixture delivery means and said cylinders.

8. The fuel intake of claim 2 in which said arcuate valve plate is mounted on the periphery of a circular plate secured to said crankshaft and has an outer cylindrical surface that slides over said main fuel inlet as the crankcase rotates.

9. The fuel intake of claim 8 in which said arcuate valve plate comprises a segment of a cylindrical wall and a flange, intermediate the edges of said wall, extends inwardly from the wall in the form of a segment of a ring that is secured to said circular plate.

10. In an internal combustion engine including a stationary crankshaft, a plurality of angularly spaced pistons mounted on and extending radially from said crankshaft; a crankcase journalled on and rotatable about said crankshaft; a plurality of angularly spaced cylinders, each having an open end and a closed end formed with combustion chamber on its inner face each of said cylinders carried by said crankcase and corresponding in number and arrangement to said pistons, with each piston being reciprocal in a cylinder; means for delivering a fuel mixture to each of said cylinders, plus an improved exhaust comprising:

(a) a plurality of angularly spaced exhaust ports in each of said cylinders; and (b) an annular manifold mounted concentric with the axis of rotation of said crankcase comprised of rotary exhaust ring sealingly coupled to a stationary annular exhaust plate and cooperating with said exhaust ports to open and close them as the crankcase rotates about the crankshaft.

11. The exhaust of claim 10 in which a liner is locationally fitted in each cylinder and cooperates therewith to define said exhaust ports.

12. The exhaust of claim 11 in which each cylinder is formed with a flat onto which said exhaust ports open and having openings therein connecting with said exhaust ports.

13. In an internal combustion engine including a stationary crankshaft, a plurality of angularly spaced pistons mounted on and extending radially from said crankshaft; a crankcase journalled on and rotatable about said crankshaft; a plurality of angularly spaced cylinders, each having an open end and a closed end formed with combustion chamber on its inner face each of said cylinders carried by said crankcase and corresponding in number and arrangement to said pistons, with each piston being reciprocal in a cylinder; means for delivering a fuel mixture to each of said cylinders, plus an improved fuel intake and exhaust comprising:

(a) a main fuel inlet in each of said cylinders connecting with the combustion chamber therein;

(b) a plurality of angularly spaced exhaust ports in each of said cylinders;

(c) an arcuate valve plate mounted on and extending radially from said crankshaft to cooperate with said main fuel inlets in succession as said crankcase rotates about said crankshaft; and (d) an annular manifold mounted concentric with the axis of rotation of said crankcase comprised of rotary exhaust ring sealingly coupled to a stationary annular exhaust plate and cooperating with said exhaust ports to open and close them as the crankcase rotates about the crankshaft.

14. The improved fuel intake and exhaust of claim 13, together with a plurality of auxiliary fuel inlets in each cylinder, arranged symmetrically relative to said main fuel inlet.

15. In an internal combustion engine including a stationary crankshaft, a plurality of angularly spaced pistons mounted on and extending radially from said crankshaft; a crankcase journalled on and rotatable about said crankshaft; a plurality of angularly spaced cylinders, each having an open end and a closed end formed with combustion chamber on its inner face each of said cylinders carried by said crankcase and corresponding in number and arrangement to said pistons, with each piston being reciprocal in a cylinder; means for delivering a fuel mixture to each of said cylinders, plus an improved spark plug assembly comprising:

(a) a passage in the end of each of said cylinders communicating with the combustion chamber therein;

(b) a spark plug in each of said passages; and (c) a ring shaped member detachably securing each spark plug in its cylinder and dissipating heat from said spark plug.

16. The spark plug assembly of claim 15 in which said passage is threaded, and has an open end at the combustion chamber of the cylinder, and the spark plug has threads complemental to those of said passage.

17. The spark plug assembly of claim 16 in which the outer end of said passage is counterbored to receive said ring shaped member and being fitted with a snap ring for securing said ring shaped member within said counterbore.

18. In an internal combustion engine including a stationary crankshaft, a plurality of angularly spaced pistons mounted on and extending radially from said crankshaft; a crankcase journalled on and rotatable about said crankshaft; a plurality of angularly spaced cylinders, each having an open end and a closed end formed with combustion chamber on its inner face of said cylinders carried by said crankcase and corresponding in number and arrangement to said pistons, with each piston being reciprocal in a cylinder; means for delivering a fuel mixture to each of said cylinders, plus an improved exhaust comprising:

(a) a plurality of angularly spaced exhaust ports in ech of said cylinders; and (b) an exhaust ring, fixedly coupled to each of said cylinders and having a plurality of intermediate exhaust passages one of each which communicates with one of each said plurality of exhaust ports in each of said cylinders.

19. The exhaust of claim 18 wherein each said intermediate exhaust passage is comprised of a first and a second opening in communication with each other at least said first opening being sized and shaped to embrace said plurality of exhaust ports in its associated cylinder.

20. The exhaust of claim 19 further comprising an annular exhaust plate sealingly coupled to said exhaust ring and stationary with respect thereto.

21. The exhaust of claim 20 wherein said annular exhaust plate comprises a plurality of exhaust outlets first ones of which return unburned products of combustion to be re-burned.

* * * * *